US008875680B2

(12) United States Patent
Yoshioka

(10) Patent No.: US 8,875,680 B2
(45) Date of Patent: Nov. 4, 2014

(54) CONTROL DEVICE FOR INTERNAL COMBUSTION ENGINE

(75) Inventor: Mamoru Yoshioka, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 662 days.

(21) Appl. No.: 13/133,083

(22) PCT Filed: Mar. 17, 2009

(86) PCT No.: PCT/JP2009/055175

§ 371 (c)(1),
(2), (4) Date: Jun. 6, 2011

(87) PCT Pub. No.: WO2010/106640

PCT Pub. Date: Sep. 23, 2010

(65) Prior Publication Data

US 2011/0232607 A1 Sep. 29, 2011

(51) Int. Cl.

| | |
|---|---|
| ***F02M 69/04*** | (2006.01) |
| ***F02D 41/00*** | (2006.01) |
| ***F02D 41/06*** | (2006.01) |

(52) U.S. Cl.

CPC ..... *F02D 41/062* (2013.01); *F02D 41/008* (2013.01); *F02D 2041/001* (2013.01)

USPC .... 123/445; 123/179.16; 123/491; 123/198 D

(58) Field of Classification Search

USPC ..... 123/90.15, 179.16, 179.21, 179.5, 123/198 F, 406.53, 406.55, 434, 435, 491, 123/543, 198 D, 198 DC; 701/103, 111, 113

See application file for complete search history.

(56) References Cited

U.S. PATENT DOCUMENTS

| | | | | |
|---|---|---|---|---|
| 6,994,060 | B2 * | 2/2006 | Yoeda | 123/90.11 |
| 2001/0017123 | A1 * | 8/2001 | Raab et al. | 123/305 |
| 2005/0205037 | A1 * | 9/2005 | Lewis et al. | 123/179.16 |
| 2006/0254564 | A1 * | 11/2006 | Lewis et al. | 123/491 |

(Continued)

FOREIGN PATENT DOCUMENTS

| | | | |
|---|---|---|---|
| JP | 61-164014 | A | 7/1986 |
| JP | 03-047434 | A | 2/1991 |

(Continued)

OTHER PUBLICATIONS

International Preliminary Report on Patentability dated Oct. 27, 2011 in International Application No. PCT/JP2009/055175.

*Primary Examiner* — Mahmoud Gimie
*Assistant Examiner* — John Zaleskas
(74) *Attorney, Agent, or Firm* — Sughrue Mion, PLLC

(57) ABSTRACT

At a time of start of an internal combustion engine, vaporization or atomization of a fuel for initial explosion is promoted, and thereby, discharge of HC can be restrained. The internal combustion engine includes a fuel injection valve which injects a fuel into an intake port, and an exhaust valve which can be stopped in a closed state for each cylinder. When the cylinder before initial explosion is in an exhaust stroke, the exhaust valve of the cylinder is stopped in a closed state. Subsequently, the fuel injection valve of the cylinder in which the exhaust valve is stopped in the closed state in the exhaust stroke is caused to inject the fuel for initial explosion so that an injection time is before opening timing of an intake valve or coincides with the opening timing.

1 Claim, 20 Drawing Sheets

(56) References Cited

U.S. PATENT DOCUMENTS

| | | | | |
|---|---|---|---|---|
| 2007/0144470 | A1* | 6/2007 | Murase et al. | 123/90.15 |
| 2009/0120390 | A1* | 5/2009 | Ezaki et al. | 123/90.15 |
| 2009/0120396 | A1* | 5/2009 | Krenus et al. | 123/179.16 |
| 2009/0145382 | A1* | 6/2009 | Kawai | 123/90.16 |
| 2009/0292441 | A1* | 11/2009 | Kawai et al. | 701/103 |

FOREIGN PATENT DOCUMENTS

| | | | | |
|---|---|---|---|---|
| JP | 2004232577 | A | * | 8/2004 |
| JP | 2005042564 | A | * | 2/2005 |
| JP | 2005-240559 | A | | 9/2005 |
| JP | 2006017004 | A | * | 1/2006 |
| JP | 2007016710 | A | * | 1/2007 |
| JP | 2007263036 | A | * | 10/2007 |
| JP | 2007-321712 | A | | 12/2007 |
| JP | 2008019809 | A | * | 1/2008 |
| JP | 2008-291686 | A | | 12/2008 |
| JP | 2009041529 | A | * | 2/2009 |
| WO | WO 2007042876 | A2 | * | 4/2007 |
| WO | WO 2009096947 | A1 | * | 8/2009 |

* cited by examiner

Fig.6

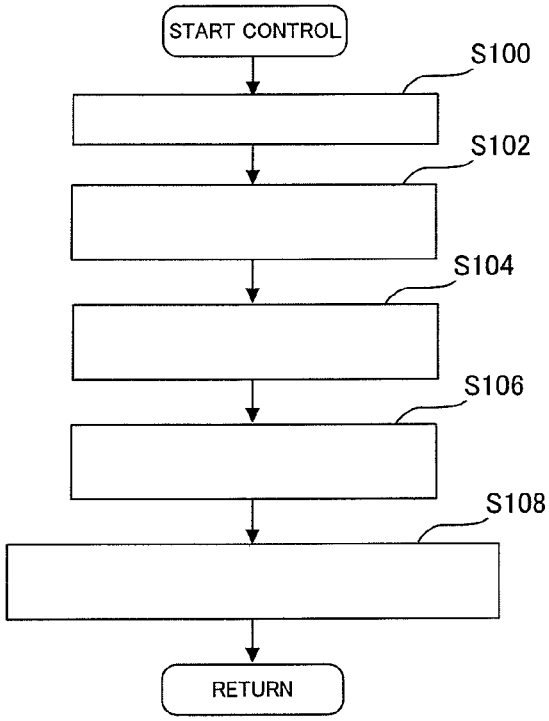

S100: DETERMINE FIRST EXPLOSION STROKE CYLINDER
S102: PERFORM EXHAUST VALVE STOP CONTROL (SEQUENTIALLY FROM FIRST EXPLOSION STROKE CYLINDER)
S104: PERFORM INTAKE—ASYNCHRONOUS INJECTION (SEQUENTIALLY FROM FIRST EXPLOSION STROKE CYLINDER)
S106: PERFORM IGNITION IN PROXIMITY TO COMPRESSION TDC (SEQUENTIALLY FROM FIRST EXPLOSION STROKE CYLINDER)
S108: REMOVE EXHAUST VALVE STOP CONTROL (SEQUENTIALLY AFTER IGNITION OF FIRST EXPLOSION STROKE CYLINDER)

Fig.10

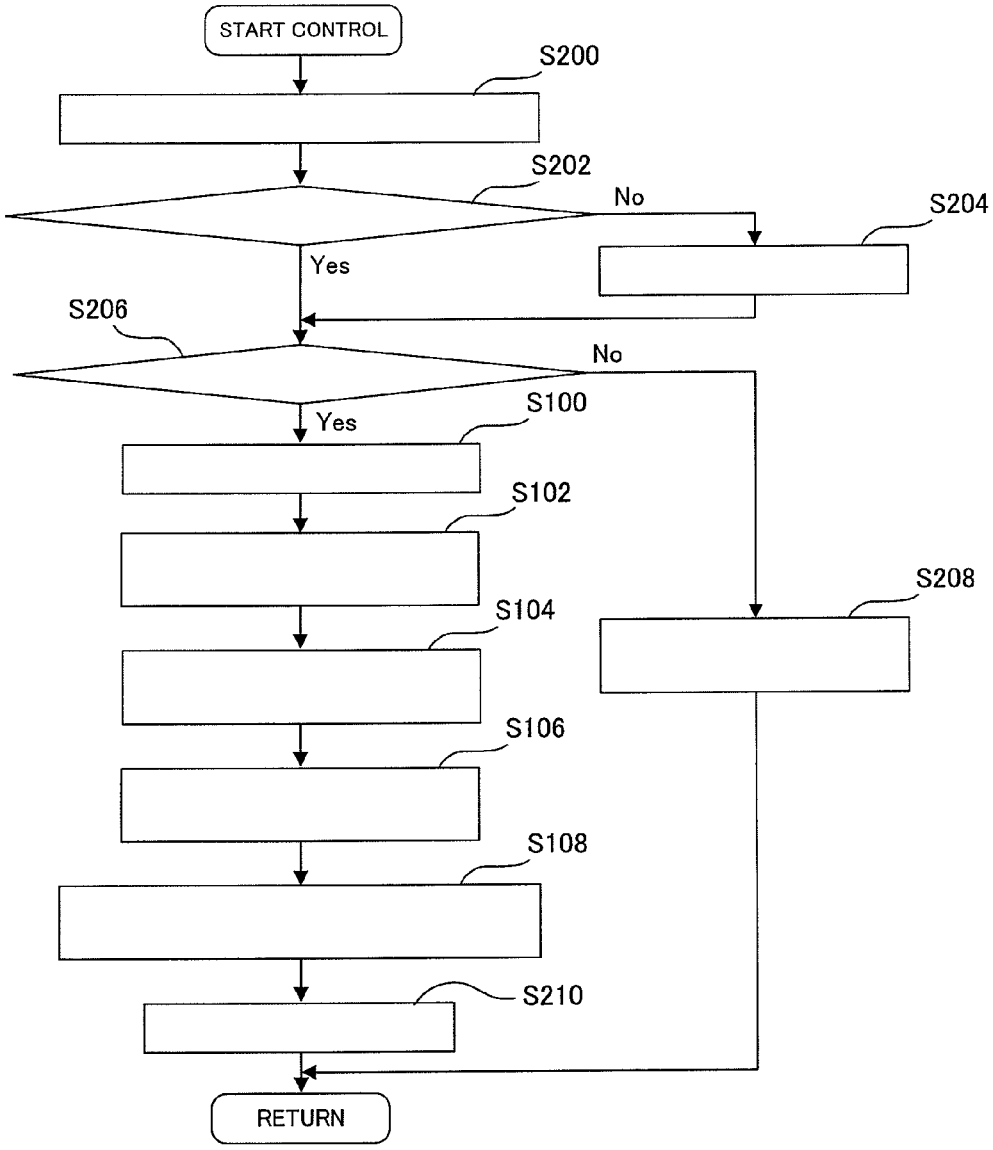

S100: DETERMINE FIRST EXPLOSION STROKE CYLINDER
S102: PERFORM EXHAUST VALVE STOP CONTROL (SEQUENTIALLY FROM FIRST EXPLOSION STROKE CYLINDER)
S104: PERFORM INTAKE−ASYNCHRONOUS INJECTION (SEQUENTIALLY FROM FIRST EXPLOSION STROKE CYLINDER)
S106: PERFORM IGNITION IN PROXIMITY TO COMPRESSION TDC (SEQUENTIALLY FROM FIRST EXPLOSION STROKE CYLINDER)
S108: REMOVE EXHAUST VALVE STOP CONTROL (SEQUENTIALLY AFTER IGNITION OF FIRST EXPLOSION STROKE CYLINDER)
S200: ACQUIRE ETHANOL CONCENTRATION AND START TIME WATER TEMPERATURE
S202: PERFORM EXHAUST VALVE STOP CONTROL?
S204: EXHAUST VALVE OPERATION FLAG = 1
S206: EXHAUST VALVE OPERATION FLAG = 0
S208: ORDINARY EXHAUST VALVE CONTROL, ORDINARY FUEL INJECTION AND ORDINARY IGNITION CONTROL
S210: EXHAUST VALVE OPERATION FLAG = 1

Fig.13

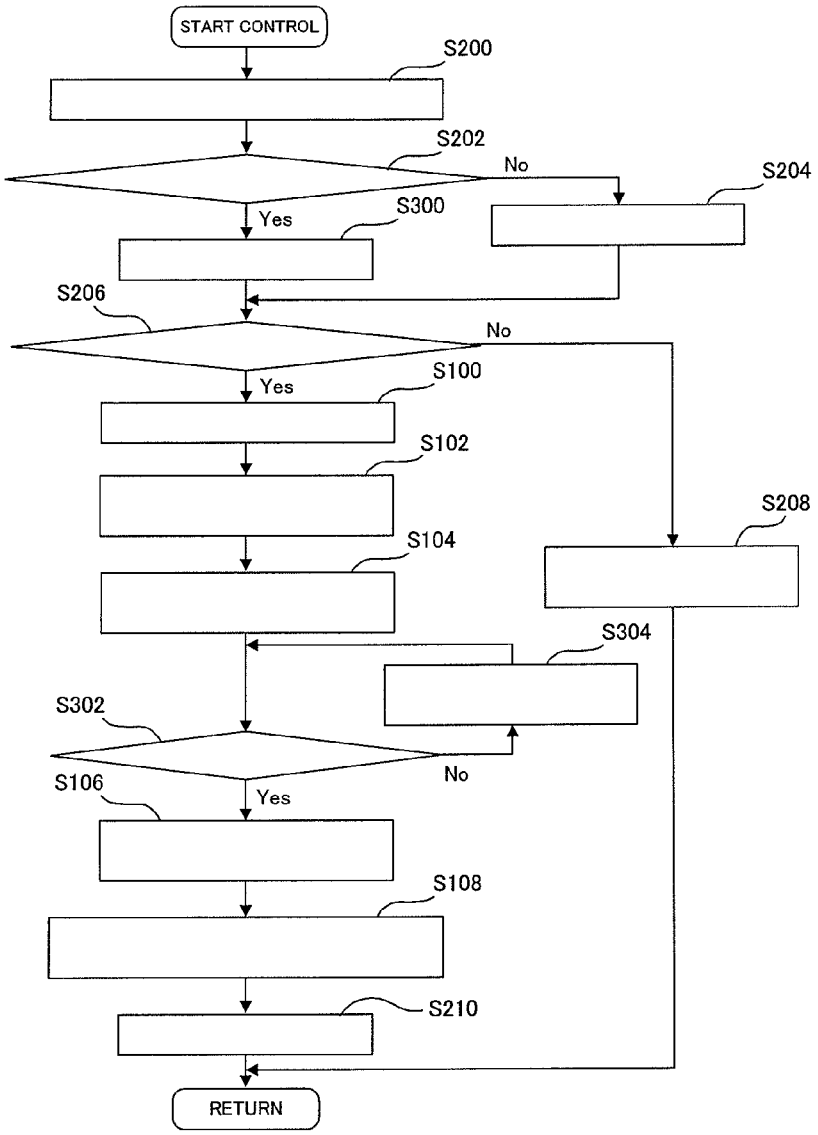

S100: DETERMINE FIRST EXPLOSION STROKE CYLINDER
S102: PERFORM EXHAUST VALVE STOP CONTROL (SEQUENTIALLY FROM FIRST EXPLOSION STROKE CYLINDER)
S104: PERFORM INTAKE—ASYNCHRONOUS INJECTION (SEQUENTIALLY FROM FIRST EXPLOSION STROKE CYLINDER)
S106: PERFORM IGNITION IN PROXIMITY TO COMPRESSION TDC (SEQUENTIALLY FROM FIRST EXPLOSION STROKE CYLINDER)
S108: REMOVE EXHAUST VALVE STOP CONTROL (SEQUENTIALLY AFTER IGNITION OF FIRST EXPLOSION STROKE CYLINDER)
S200: ACQUIRE ETHANOL CONCENTRATION AND START TIME WATER TEMPERATURE
S202: PERFORM EXHAUST VALVE STOP CONTROL?
S204: EXHAUST VALVE OPERATION FLAG = 1
S206: EXHAUST VALVE OPERATION FLAG = 0
S208: ORDINARY EXHAUST VALVE CONTROL, ORDINARY FUEL INJECTION AND ORDINARY IGNITION CONTROL
S210: EXHAUST VALVE OPERATION FLAG = 1
S300: DETERMINE THE NUMBER OF STOP CYCLES
S302: THE NUMBER OF STOP CYCLES ELAPSED
S304: CONTINUE CRANKING WHILE STOPPING IGNITION

Fig.15

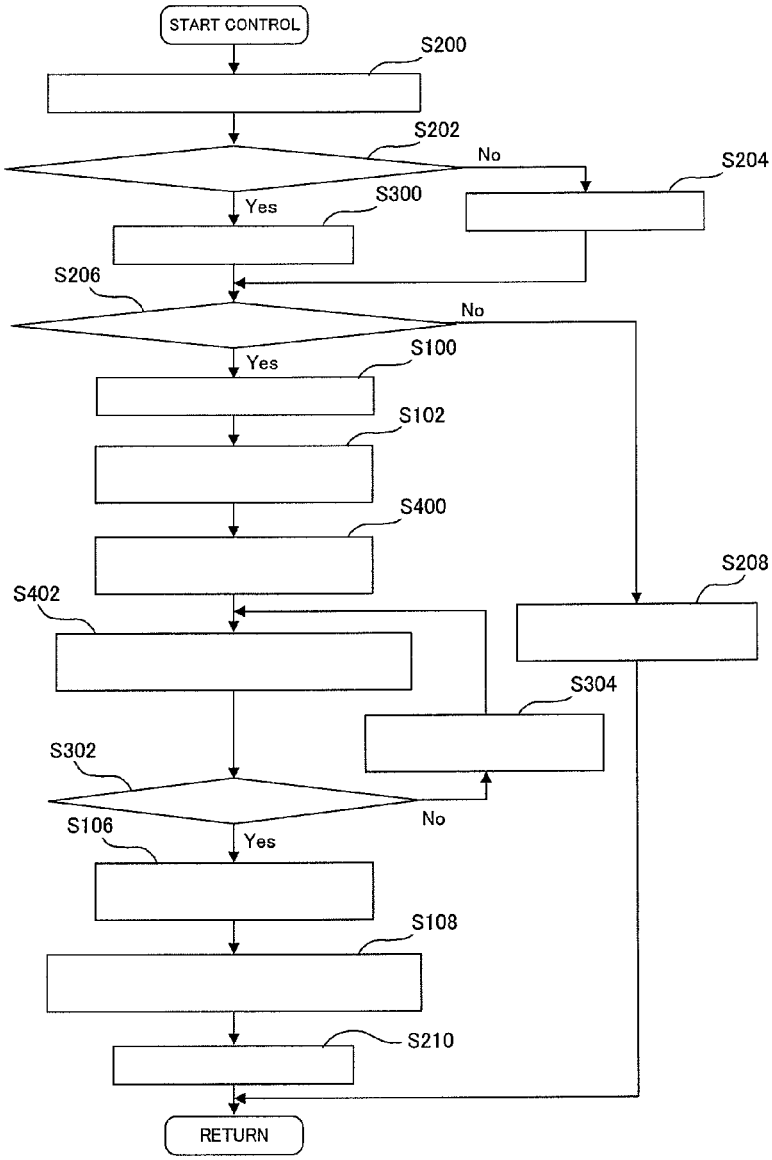

S100: DETERMINE FIRST EXPLOSION STROKE CYLINDER
S102: PERFORM EXHAUST VALVE STOP CONTROL (SEQUENTIALLY FROM FIRST EXPLOSION STROKE CYLINDER)
S106: PERFORM IGNITION IN PROXIMITY TO COMPRESSION TDC (SEQUENTIALLY FROM FIRST EXPLOSION STROKE CYLINDER)
S108: REMOVE EXHAUST VALVE STOP CONTROL (SEQUENTIALLY AFTER IGNITION OF FIRST EXPLOSION STROKE CYLINDER)
S200: ACQUIRE ETHANOL CONCENTRATION AND START TIME WATER TEMPERATURE
S202: PERFORM EXHAUST VALVE STOP CONTROL?
S204: EXHAUST VALVE OPERATION FLAG = 1
S206: EXHAUST VALVE OPERATION FLAG = 0
S208: ORDINARY EXHAUST VALVE CONTROL, ORDINARY FUEL INJECTION AND ORDINARY IGNITION CONTROL
S210: EXHAUST VALVE OPERATION FLAG = 1
S300: DETERMINE THE NUMBER OF STOP CYCLES
S302: THE NUMBER OF STOP CYCLES ELAPSED
S304: CONTINUE CRANKING WHILE STOPPING IGNITION
S400: CALCULATE FUEL INJECTION AMOUNT FOR EACH CYCLE IN ACCORDANCE WITH THE NUMBER OF STOP CYCLES
S402: PERFORM FUEL INJECTION COINCIDENT WITH OPENING TIMING OF INTAKE VALVE (SEQUENTIALLY FROM FIRST EXPLOSION STROKE CYLINDER)

Fig.17

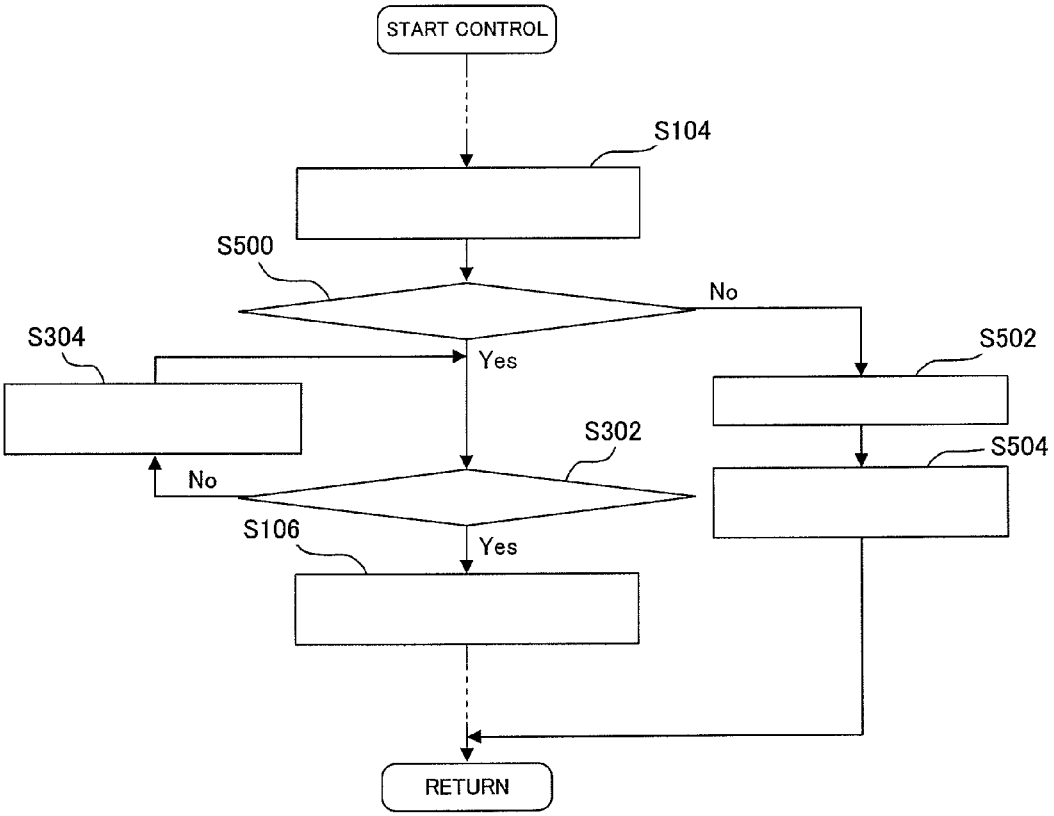

S104: PERFORM INTAKE—ASYNCHRONOUS INJECTION (SEQUENTIALLY FROM FIRST EXPLOSION STROKE CYLINDER)
S106: PERFORM IGNITION IN PROXIMITY TO COMPRESSION TDC (SEQUENTIALLY FROM FIRST EXPLOSION STROKE CYLINDER)
S302: THE NUMBER OF STOP CYCLES ELAPSED
S304: CONTINUE CRANKING WHILE STOPPING IGNITION
S500: EXHAUST VALVE STOP OK?
S502: SUSPEND EXHAUST VALVE STOP CONTROL
S504: ORDINARY EXHAUST VALVE CONTROL, ORDINARY FUEL INJECTION AND ORDINARY IGNITION

Fig.19

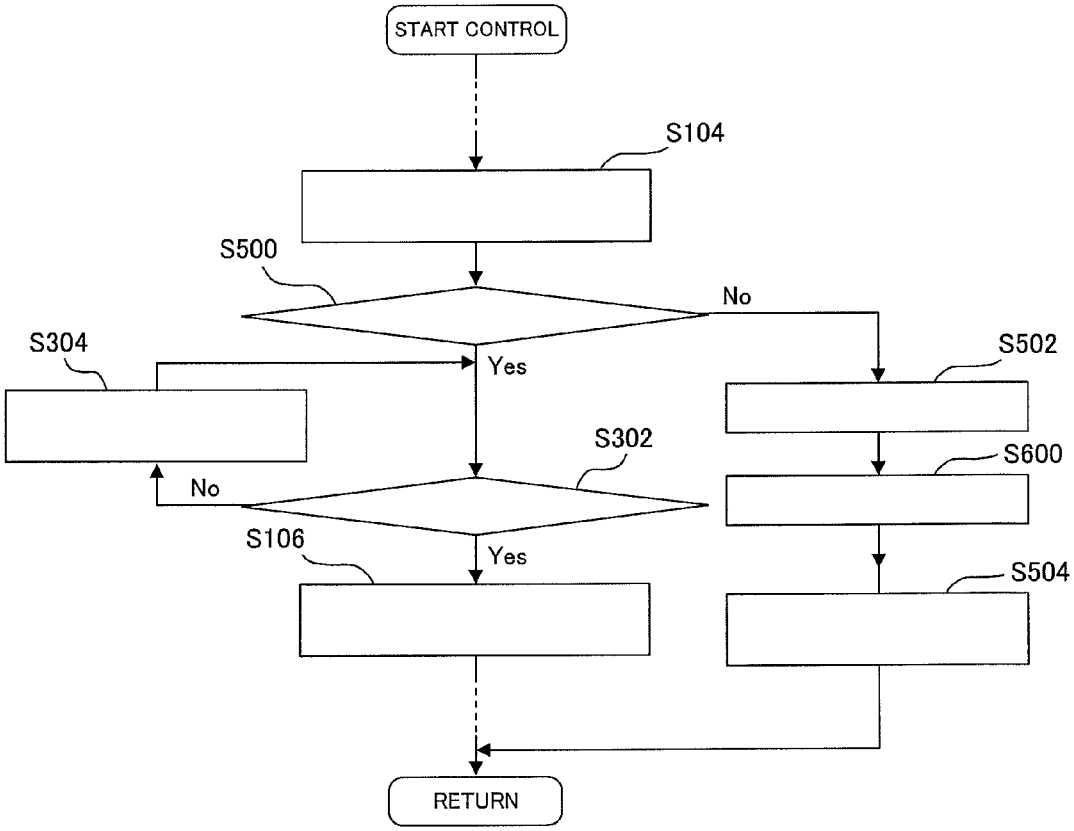

S104: PERFORM INTAKE−ASYNCHRONOUS INJECTION (SEQUENTIALLY FROM FIRST EXPLOSION STROKE CYLINDER)
S106: PERFORM IGNITION IN PROXIMITY TO COMPRESSION TDC (SEQUENTIALLY FROM FIRST EXPLOSION STROKE CYLINDER)
S302: THE NUMBER OF STOP CYCLES ELAPSED
S304: CONTINUE CRANKING WHILE STOPPING IGNITION
S500: EXHAUST VALVE STOP OK?
S502: SUSPEND EXHAUST VALVE STOP CONTROL
S504: ORDINARY EXHAUST VALVE CONTROL, ORDINARY FUEL INJECTION AND ORDINARY IGNITION CONTROL
S600: IMPLEMENT ADDITIONAL FUEL INJECTION

S106: PERFORM IGNITION IN PROXIMITY TO COMPRESSION TDC (SEQUENTIALLY FROM FIRST EXPLOSION STROKE CYLINDER)
S108: REMOVE EXHAUST VALVE STOP CONTROL (SEQUENTIALLY AFTER IGNITI ON OF FIRST EXPLOSION STROKE CYLINDER)
S700: IGNITION OK?
S702: CONTINUE EXHAUST VALVE STOP CONTROL AND STOP FUEL INJECTION

CONTROL DEVICE FOR INTERNAL COMBUSTION ENGINE

CROSS REFERENCE TO RELATED APPLICATIONS

This application is a National Stage of International Application No. PCT/JP2009/055175 filed Mar. 17, 2009, the content of which is incorporated herein by reference in its entirety.

TECHNICAL FIELD

The present invention relates to a control device for an internal combustion engine, and more particularly relates to a control device which includes a function of restraining discharge of HC at a time of start in a port injection type internal combustion engine which injects a fuel into an intake port.

BACKGROUND ART

As the art of restraining the discharge of HC at the time of start of a port injection type internal combustion engine, an art is known, which is described in Japanese Patent Laid-Open No. 2008-291686. The art described in Japanese Patent Laid-Open No. 2008-291686 sets the closing timing of the exhaust valve at an advance side from the intake top dead center by operating the variable valve timing mechanism, opens the intake valve in proximity to the intake top dead center after the exhaust valve is closed, and performs intake-asynchronous injection prior to opening of the intake valve. By closing the exhaust valve in the timing earlier at an advance side from the intake top dead center, part of the combustion gas can be confined in the combustion chamber. Subsequently, a fuel is injected into the port by intake-asynchronous injection, and thereafter, the intake valve is opened in proximity to the intake top dead center, whereby vaporization of the fuel can be promoted by the combustion gas which is blown back to the intake port from the inside of the combustion chamber.

However, the art described in Japanese Patent Laid-Open No. 2008-291686 is still susceptible to improvement. At the first cycle of start of each cylinder, that is, before initial explosion, the gas which is blown back to the intake port does not contain combustion gas. Further, the negative pressure of the intake port at the time of start of an internal combustion engine is small, and especially in the case before explosion, the intake port has substantially atmospheric pressure. Accordingly, the pressure difference between the intake port and the combustion chamber is small when the intake vale is opened, and the amount of the gas itself which is blown back is not large. Accordingly, in regard with the first cycle of start, the fuel for initial explosion which is injected to the intake port is unlikely to be sufficiently vaporized.

DISCLOSURE OF THE INVENTION

The present invention is made to solve the problem as described above, and has an object to provide a control device for an internal combustion engine which promotes vaporization or atomization of a fuel for initial explosion at a time of start of the internal combustion engine, and thereby, can restrain discharge of HC.

A control device according to the present invention is a control device for an internal combustion engine having a fuel injection valve which injects a fuel into an intake port, and an exhaust valve which can be stopped in a closed state for each cylinder. The feature of the control device according to the present invention lies in the content of the control of the actuators, that is, the fuel injection valve and the exhaust valve at the time of start.

When a cylinder before initial explosion is in an exhaust stroke, means which controls the exhaust valve stops the exhaust valve of the cylinder in a closed state. As the timing of stopping the exhaust valve, the exhaust valve needs to be stopped by the time of the exhaust stroke before the initial explosion at the latest, the exhaust valve may be stopped before start of cranking, or if there are several cycles from the start of cranking to the initial explosion, the exhaust valve may be stopped immediately before the initial explosion. The exhaust valve of the cylinder is preferably opened in the exhaust stroke immediately after the initial explosion. Means for stopping the exhaust valve is not limited. For example, the means for separating the cam and the exhaust valve, means that adopts a motor-driven type cam and stops the rotation of the cam, and means which adopts an electromagnetically driven type exhaust valve as the exhaust valve itself can be used.

Means which controls the fuel injection valve causes the fuel injection valve to inject a fuel so that an injection time is before an opening timing of an intake valve or coincides with the opening timing. However, fuel injection is started on a condition, that is, the condition that the cylinder goes through the exhaust stroke with the exhaust valve in a closed state, that is, it is the condition for starting fuel injection that in the cylinder, the exhaust valve is stopped in a closed state in the exhaust stroke. The kind of the fuel which is injected by the fuel injection valve is not limited, but the present invention is preferably used in the internal combustion engine that uses a fuel which is difficult to vaporize at a low temperature, for example, heavy gasoline and an alcohol fuel.

According to the control device according to the present invention, the exhaust valve is stopped in the closed state in the exhaust stroke, whereby the gas in the combustion chamber is compressed by the piston, and the intake valve is opened when the pressure in the combustion chamber becomes high. Accordingly, when the intake valve is opened, the combustion gas does not exist before initial explosion, but blowback of the gas to the intake port from the combustion chamber occurs due to the pressure difference between the intake port and the combustion chamber. Meanwhile, the fuel for initial explosion is injected so that the injection time period is before the opening timing of the intake valve or coincides with the opening timing, and therefore, in the timing of opening of the intake valve, the fuel is in a misty state toward the intake valve, or becomes droplets and accumulates in proximity to the intake valve. Accordingly, when the intake valve is opened, the fuel in the intake port is blown off and stirred by the gas which is blown back to the intake port from the combustion chamber, and becomes a fuel vapor which is in a more advanced state of vaporization or a fuel in a misty state which is in a more advanced state of atomization. The effect of promoting vaporization or atomization of the fuel which the present invention has become more remarkable as the fuel is more difficult to vaporize, in particular, in the fuel containing alcohol.

Further, in the control device according to the present invention, only when a certain condition is satisfied, the exhaust valve of the cylinder before initial explosion may be stopped in the closed state. Unless the condition is satisfied, the exhaust valve is operated as usual. One of such conditions is the condition in the case of use the fuel containing alcohol, and is that the alcohol concentration of the fuel is a predetermined concentration or higher. As the alcohol concentration is higher, the fuel is more difficult to vaporize, and therefore, if the alcohol concentration is the reference concentration or higher, the exhaust valve of the cylinder before initial explosion is stopped in the closed state to generate blowback of the cylinder inside gas. Further, another condition is the condition which does not depend on the property of the fuel, and is that the water temperature of the internal combustion engine is the predetermined reference temperature or lower. Since as the water temperature is lower, the temperature of the intake port wall surface is lower, and the fuel is more difficult to vaporize, the exhaust valve of the cylinder before initial explosion is stopped in the closed state and blowback of the cylinder inside gas is generated, if the water temperature is the reference temperature or lower.

In a more preferable mode of the present invention, by means which controls ignition, ignition of the cylinder is stopped until one or a plurality of cycles elapses or elapse after the fuel for initial explosion is injected in each cylinder before initial explosion. Further, by the means which controls the exhaust valve, the exhaust valve of the cylinder is stopped in the closed state until a number of cycles in which the ignition is stopped elapse. More specifically, even after the fuel for initial explosion is injected, ignition is not performed, and cranking with the exhaust valve closed is performed for one or a plurality of cycles. By causing the internal combustion engine to perform such an operation, blowback of the gas compressed in the cylinder to the intake port is repeated, and vaporization or atomization of the fuel for initial explosion is promoted.

Occurrence of a trouble to any one of the ignition control and the exhaust valve control for some reason is conceivable. Further, it is conceivable that corporation between the ignition control and the exhaust valve control does not favorably proceed. For example, it may happen that the exhaust valve opens even though the number of cycles in which the ignition is stopped has not elapsed. Further, it may happen that ignition is not executed even though the number of cycles in which the ignition is stopped has elapsed. If the situation as the former occurs, ignition of the cylinder is executed in the ignition timing directly after the exhaust valve erroneously opens. If the situation as the latter occurs, the exhaust valve of the cylinder is being stopped in the closed state continuously until ignition is executed. By implementing these measures, unburned gas can be prevented from being discharged directly from the internal combustion engine.

In a more preferable mode of the present invention, the means which controls the fuel injection valve divides injection of the fuel for initial explosion into the number of times corresponding to the number of cycles in which the ignition is stopped. The fuel injection valve of the cylinder is caused to inject the fuel so that an injection time in each injection coincides with the opening timing of the intake valve. More specifically, the fuel injection is implemented so that the gas blown back and the injected fuel collide with each other, in accordance with repetition of blowback of the gas compressed in the cylinder to the intake port. By causing the internal combustion engine to perform such an operation, the energy which is given to the fuel by high-pressure gas which is blown back becomes large, and vaporization or atomization of the fuel for initial explosion is further promoted.

Further, as a more preferable mode of the present invention, if the fuel which is injected from the fuel injection valve is a fuel containing alcohol, the number of cycles in which ignition is stopped may be changed in accordance with the alcohol concentration of the fuel. Furthermore, if the alcohol concentration of the fuel is lower than the predetermined reference concentration, ignition may be started from a first cycle of each cylinder. In this case, by the means which controls the exhaust valve, the exhaust valve is opened from the first cycle of each cylinder. By causing the internal combustion engine to perform such an operation, restraint of discharge of HC by promotion of vaporization or atomization of the fuel, and the starting performance of the internal combustion engine can be favorably made compatible.

Further, as another preferable mode of the present invention, the number of cycles in which the ignition is stopped may be changed in accordance with a water temperature of the internal combustion engine. Furthermore, ignition may be started from the first cycle of each cylinder when the water temperature of the internal combustion engine is higher than a predetermined reference temperature. In this case, by the means which controls the exhaust valve, the exhaust valve is opened from the first cycle of each cylinder. The internal combustion engine is caused to perform such an operation, whereby, at the time of cold start of the internal combustion engine, restraint of discharge of HC by promotion of vaporization or atomization of the fuel, and the starting performance of the internal combustion engine can be favorably made compatible.

BRIEF DESCRIPTION OF THE DRAWINGS

FIG. 6 shows the start control which is executed in embodiment 1 of the present invention in a flowchart.

FIG. 10 shows the start control which is executed in embodiment 2 of the present invention in a flowchart.

FIG. 13 shows the start control which is executed in embodiment 3 of the present invention in a flowchart.

FIG. 15 shows the start control which is executed in embodiment 4 of the present invention in a flowchart.

FIG. 17 shows the start control which is executed in embodiment 5 of the present invention in a flowchart.

FIG. 19 shows the start control which is executed in embodiment 6 of the present invention in a flowchart.

BEST MODE FOR CARRYING OUT THE INVENTION

Embodiment 1

Hereinafter, embodiment 1 of the present invention will be described with reference to each of FIGS. 1 to 8.

Figure 1:
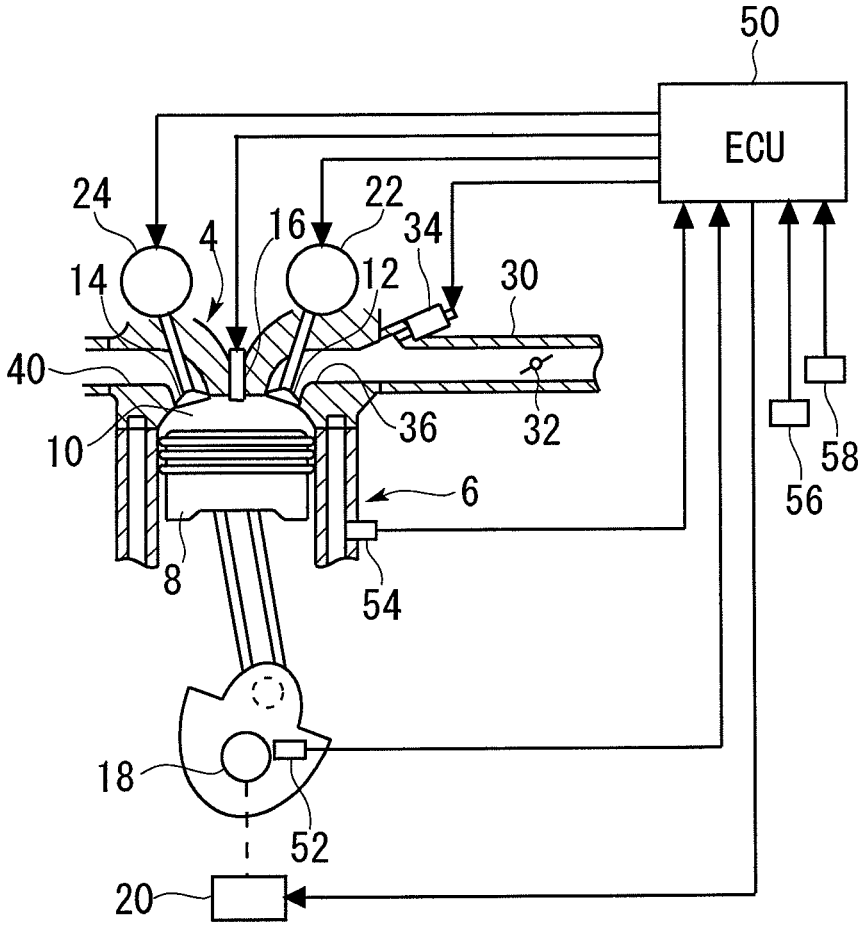
FIG. 1 is a schematic view showing a configuration of an internal combustion engine to which a control device as embodiment 1 of the present invention is applied.

FIG. 1 is a schematic view showing a configuration of an internal combustion engine (hereinafter, simply called an engine) to which a control device as embodiment 1 of the present invention is applied. The engine according to the present embodiment is a spark ignition type four stroke one cycle engine which is loaded on a vehicle such as an automobile. Though not illustrated, the engine according to the present embodiment is a four-cylinder engine including four cylinders. In a cylinder block 6 of the engine, a piston 8 is disposed in each of cylinders. A space from a top surface of the piston 8 to a cylinder head 4 forms a combustion chamber 10. An ignition plug 16 is attached to a top portion of the combustion chamber 10. Further, an intake port 36 and an exhaust port 40 which communicate with the combustion chamber 10 are formed in the cylinder head 4.

An intake valve 12 which controls the communication state of the intake port 36 and the combustion chamber 10 is provided in a connection portion of the intake port 36 and the combustion chamber 10. Each of the cylinders is provided with two of the intake valves 12. A drive system of the intake valve 12 includes an intake valve variable valve timing mechanism 22 which changes opening and closing timing of the intake valve 12 by changing the phase of an intake side camshaft with respect to a crankshaft. Since the structure and operation of such a variable valve timing mechanism (VVT) are widely known, the detailed explanation in the present description will be omitted.

An intake pipe 30 is connected to the intake port 36. A throttle 32 is disposed in the intake pipe 30. The intake pipe 30 branches to each of the cylinders downstream of the throttle 32, and is connected to the intake port 36 of each of the cylinders. A fuel injection valve 34 which injects a fuel to the intake valve 12 from the intake port 36 is attached in proximity to a connection portion of the intake pipe 30 to the intake port 36. As a fuel, alcohol such as ethanol, a composite fuel of alcohol and gasoline can be used, besides gasoline.

An exhaust valve 14 which controls a communication state of the exhaust port 40 and the combustion chamber 10 is provided in a connection portion of the exhaust port 40 and the combustion chamber 10. Each of the cylinders is provided with two of the exhaust valves 14. A drive system of the exhaust valve 14 includes an exhaust valve stop mechanism 24 which can stop the exhaust valve 14 in a closed state. The exhaust valve stop mechanism 24 is included in each of the cylinders, and the engine according to the present embodiment can stop the exhaust valve 14 according to each of the cylinders. The configuration and operation of the exhaust valve stop mechanism 24 will be described in detail with use of the drawings later.

The engine according to the present embodiment includes an ECU (Electronic Control Unit) 50 as a control device thereof. Various kinds of equipment such as a starter 20 is connected to an output side of the ECU 50 in addition to the aforementioned intake valve variable valve timing mechanism 22, exhaust valve stop mechanism 24, fuel injection valve 34, throttle 32 and ignition plug 16. Various sensors such as a crank angle sensor 52, a water temperature sensor 54, and an alcohol concentration sensor 56 and various switches such as a start switch 58 are connected to an input side of the ECU 50. The crank angle sensor 52 is a sensor which outputs a signal corresponding to a rotational angle of a crankshaft 18. The water temperature sensor 54 is a sensor which outputs a signal corresponding to a cooling water temperature of the engine. The alcohol concentration sensor 56 is a sensor which outputs a signal corresponding to the concentration of alcohol included in a fuel. The start switch 58 is a switch which accepts a start request to the engine from a driver. The ECU 50 operates each of the devices in accordance with a predetermined control program based on each of the outputs from these sensors and switches.

Figure 2:
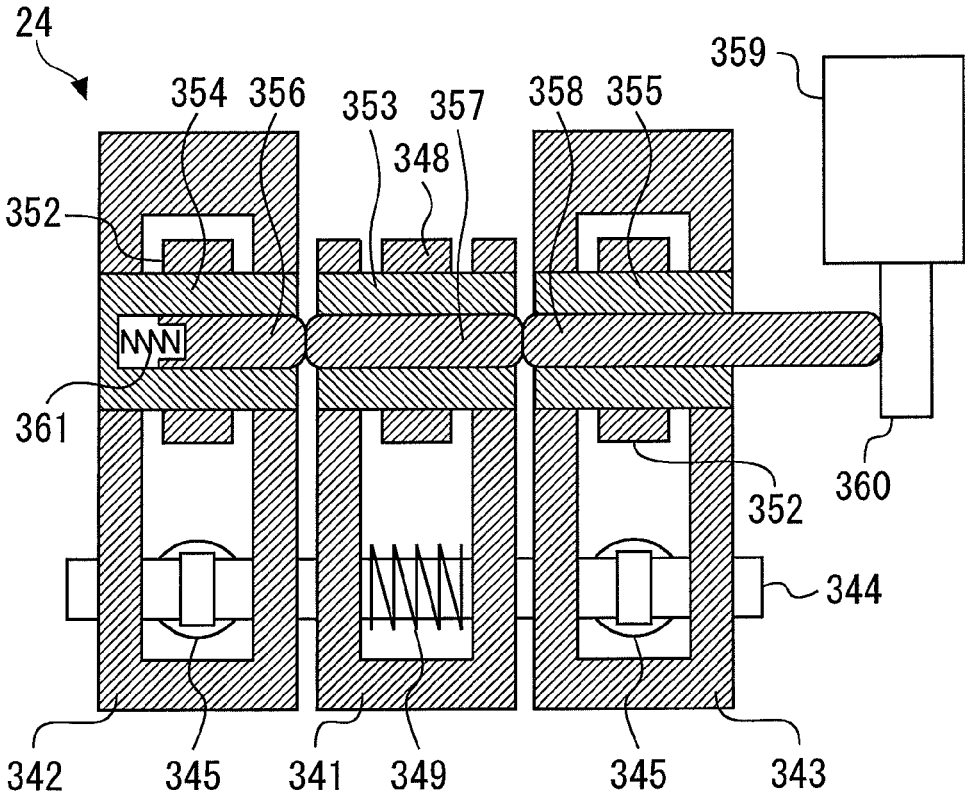
FIG. 2 is a sectional view showing a configuration of an exhaust valve stop mechanism according to embodiment 1 of the present invention.
Figure 5:
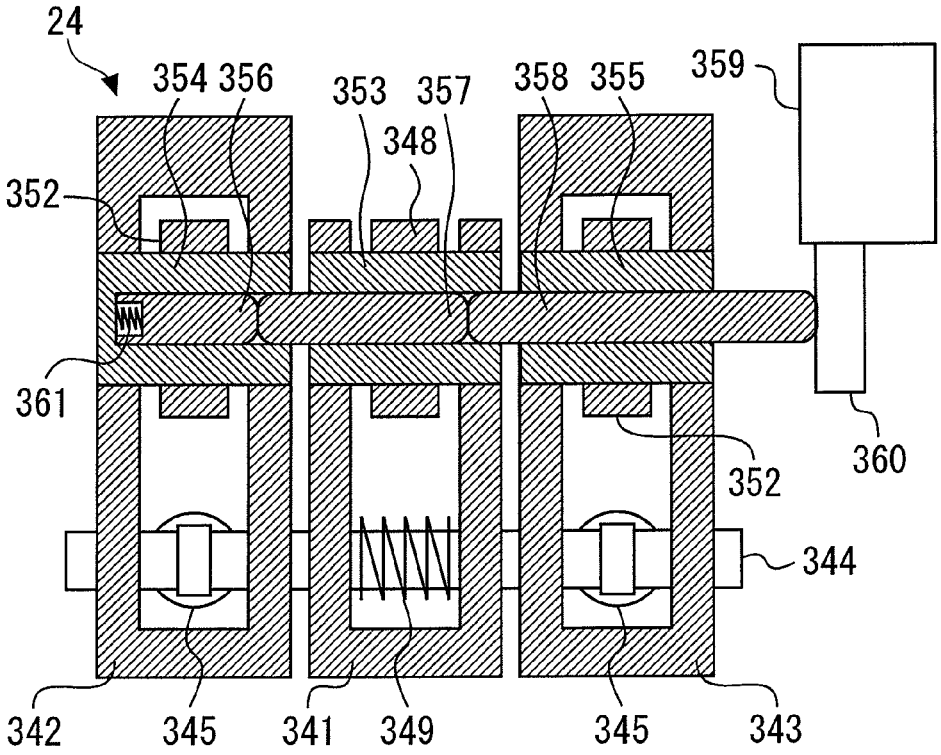
FIG. 5 is a sectional view showing an exhaust valve stopping state of the exhaust valve stop mechanism shown in FIG. 2.

Here, FIGS. 2 and 5 are sectional views each showing a configuration of the exhaust valve stop mechanism 24 according to the present embodiment. As shown in FIG. 2 or FIG. 5, the exhaust valve stop mechanism 24 includes a first rocker arm 341 and a pair of second rocker arms 342 and 343 disposed at both sides thereof. The rocker arms 341, 342 and 343 are rockable around a common rocker shaft 344. The rocker shaft 344 is supported by the cylinder head via a pair of hydraulic lash adjusters 345.

Figure 3:
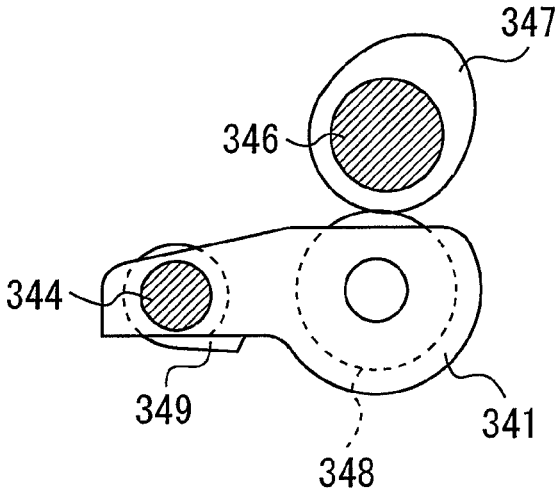
FIG. 3 is a side view of a first rocker arm of the exhaust valve stop mechanism shown in FIG. 2.

FIG. 3 is a side view of the first rocker arm 341. As shown in the drawing, the exhaust valve stop mechanism 24 has a camshaft 346. The camshaft 346 is connected to the crankshaft via a timing chain or the like, and rotates at a speed of a half of that of the crankshaft. The camshaft 346 includes a cam 347. Meanwhile, the first rocker arm 341 is provided with a roller 348. The first rocker arm 341 is urged counterclockwise in FIG. 3 by a torsion coil spring 349. By the urging force, the roller 348 is pressed against the cam 347. By such a configuration, the first rocker arm 341 is rocked with rotation of the cam 347.

Figure 4:
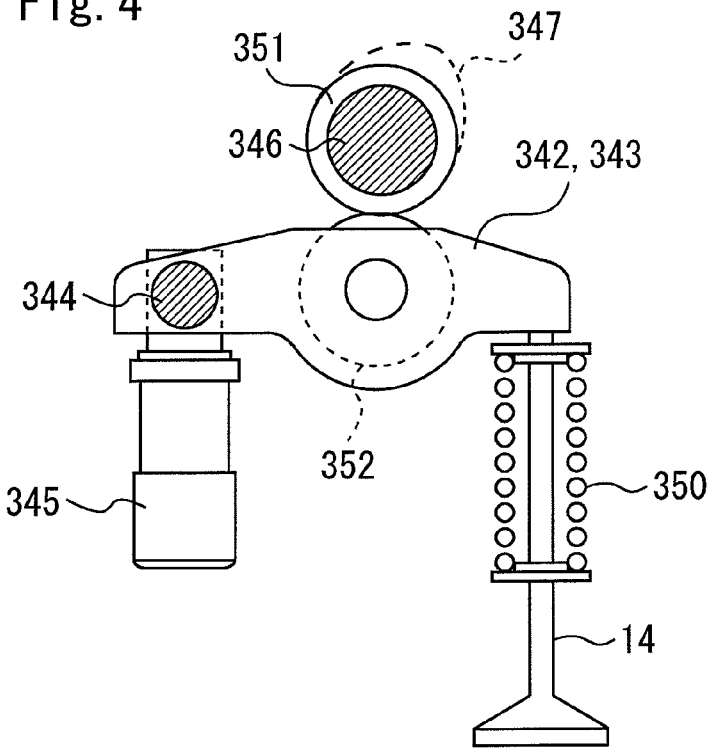
FIG. 4 is a side view of a second rocker arm of the exhaust valve stop mechanism shown in FIG. 2.

FIG. 4 is a side view of the second rocker arms 342 and 343. As shown in the drawing, movable ends of the second rocker arms 342 and 343 abut on end portions of valve stems of the two exhaust valves 14. The exhaust valve 14 is urged in the closing direction by a valve spring 350. The camshaft 346 includes a pair of zero lift cams 351 at both ends of the aforementioned cam 347. The zero lift cam 351 forms a perfect circle having a radius equal to a base circle of the cam 347. The second rocker arms 342 and 343 are each provided with a roller 352. The outside diameter of the roller 352 is equal to the outside diameter of the roller 348 (shown in FIG. 3) provided at the first rocker arm 341. Further, the distance between the center of the rocker shaft 344 and the center of the roller 352 is equal to the distance between the center of the rocker shaft 344 and the center of the roller 348. While the exhaust valve 14 is closed, the roller 352 abuts on the zero lift cam 351.

The exhaust valve stop mechanism 24 switches the state in which the first rocker arm 341 and the second rocker arms 342 and 343 are separated from each other, and the state in which the first rocker arm 341 and the second rocker arms 342 and 343 are connected, and thereby can switch the operating state and the stopping state of the exhaust valve 14. Hereinafter, the mechanism of the switch will be described.

As shown in FIG. 2 or FIG. 5, the first rocker arm 341 has a sleeve 353 which is installed concentrically with the roller 348. The second rocker arms 342 and 343 respectively have sleeves 354 and 355 which are installed concentrically with the rollers 352. Pins 357, 356 and 358 are respectively inserted in the respective sleeves 353, 354 and 355. A tip end at an outside of the pin 358 is projected beyond a side surface of the second rocker arm 343. The projected tip end of the pin 358 abuts on a displacement member 360 of an actuator 359. The actuator 359 can displace the displacement member 360 in the lateral direction in FIGS. 2 and 5 in accordance with the command of the ECU 50. Meanwhile, an outer side of the sleeve 354 of the second rocker arm 342 is closed, and a spring 361 is installed therein. The spring 361 presses the pin 356 in the right direction in FIGS. 2 and 5. Thereby, the pins 356, 357 and 358 are urged in the right direction in FIGS. 2 and 5.

FIG. 2 shows the state in which the first rocker arm 341, and the second rocker arms 342 and 343 are separated from each other. In the separated state, the pin 356 is engaged with only the sleeve 354 of the second rocker arm 342, and is detached from the adjacent sleeve 353. Further, the pin 357 is engaged with only the sleeve 353 of the first rocker arm 341, and is detached from the adjacent sleeves 354 and 355. The pin 358 is engaged with only the sleeve 355 of the second rocker arm 343, and is detached from the adjacent sleeve 353. Accordingly, even if the first rocker arm 341 is rocked by rotation of the cam 347 (see FIG. 3), the rocking is not transmitted to the second rocker arms 342 and 343. The rollers 352 of the second rocker arms 342 and 343 are in contact with the zero lift cam 351 (see FIG. 4) which does not have a cam crest. Accordingly, even if the camshaft 346 (see FIGS. 3 and 4) rotates, the second rocker arms 342 and 343 do not rock and the exhaust valve 14 (see FIG. 4) is kept stopped in a closed state.

In the state in which the first rocker arm 341 and the second rocker arms 342 and 343 are separated, when the roller 348 of the first rocker arm 341 is in contact with the base circle of the cam 347, the centers of the pins 356, 357 and 358 correspond to one another. At this time, the actuator 359 is operated, and the pins 356, 357 and 358 are moved in the left direction in FIG. 2, whereby the state can be switched to the connected state shown in FIG. 5.

In the state shown in FIG. 5, part of the pin 357 is inserted in the sleeve 354 of the second rocker arm 342, and part of the pin 358 is inserted in the sleeve 353 of the first rocker arm 341. Thereby, the first rocker arm 341 and the second rocker arm 342 are connected via the pin 357, and the first rocker arm 341 and the second rocker arm 343 are connected via the pin 358. Accordingly, when the first rocker arm 341 rocks due to rotation of the cam 347 (see FIG. 3), the second rocker arms 342 and 343 also rock with this, and therefore, the exhaust valve 14 (see FIG. 4) performs an opening and closing operation in synchronous with rotation of the camshaft 346 (see FIGS. 3 and 4).

When the connection of the first rocker arm 341 and the second rocker arms 342 and 343 is released, the displacement member 360 is displaced in the right direction in FIG. 5 by the actuator 359. In this manner, the pins 356, 357 and 358 are displaced in the right direction in FIG. 5 by the urging force of the spring 361. As a result, the state can be switched to the separated state shown in FIG. 2, that is, the exhaust valve stopping state. As above, the exhaust valve stop mechanism 24 is the mechanism which can instantly switch the state of operating the exhaust valve 14 and the state of closing and stopping the exhaust valve 14 by switching the state in which the first rocker arm 341 and the second rocker arms 342 and 343 are connected (state shown in FIG. 5) and the state in which they are separated (state shown in FIG. 2).

The exhaust valve stop mechanism 24 described above is used in start control of the engine. FIG. 6 shows the content of start control which is executed by the ECU 50 in the present embodiment in a flowchart. Start control of the engine is executed at the same time as cranking of the engine is started by the starter 20 after the start switch 58 is turned on.

According to the flowchart of FIG. 6, in the first step S100, the cylinder which firstly reaches an explosion stroke is determined based on the signal issued from the crank angle sensor 52. Here, the first cylinder is assumed to be determined as the first explosion stroke cylinder.

In the next step S102, exhaust valve stop control is performed in the sequence of ignition from the first explosion stroke cylinder. In exhaust valve stop control, the state is switched to the state in which the first rocker arm 341 and the second rocker arms 342 and 343 are separated (state shown in FIG. 2) by operation of the actuator 359 by the ECU 50. This operation is performed before the target cylinder enters the exhaust stroke, that is, before the exhaust valve 14 starts to open. As a result, the exhaust valve 14 does not open even in the exhaust stroke, and is stopped in the closed state. The ignition sequence in a four-cylinder engine is the sequence of the first cylinder, the third cylinder, the fourth cylinder and the second cylinder, and therefore, stop control of the exhaust valve is also performed for each cylinder in this sequence.

In the next step S104, in the ignition sequence from the first explosion stroke cylinder, that is, in the sequence of the first cylinder, the third cylinder, the fourth cylinder and the second cylinder, intake-asynchronous injection of the initial explosion fuel is performed. Intake-asynchronous injection is fuel injection which is implemented before the intake valve 12 is opened as is known. In the present embodiment, intake-asynchronous injection of the initial explosion fuel is assumed to be performed so that the end time of the fuel injection time period coincides with the opening timing of the intake valve 12. The fuel which is injected from the fuel injection valve 32 scatters towards the intake valve 12 and becomes droplets to adhere to a wall surface of the intake port 36 and an umbrella portion of the intake valve 12, or is in a misty state to drift in the intake port 36.

Figure 7:
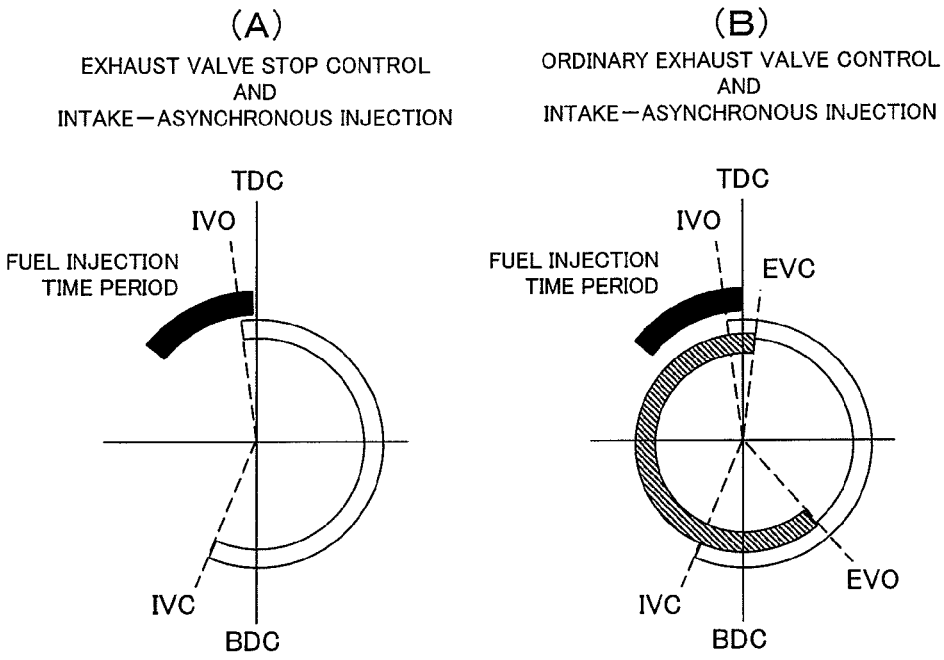
FIG. 7 is a chart showing opening/closing timing of an intake valve and an exhaust valve and fuel injection time period in embodiment 1 of the present invention.

FIG. 7 shows the content of the processing of the above steps S102 and S104 in the drawing. FIG. 7 shows the opening/closing timing of the intake valve 12 and the exhaust valve 14 and the fuel injection time period in combination. (A) at the left side shows each timing during exhaust valve stop control, and (B) at the right side shows each timing during ordinary exhaust valve control. Ordinary exhaust valve control means that exhaust valve stop control is not implemented, that is, the exhaust valve 14 is opened and closed synchronously with the crankshaft 18. In FIG. 7, IVO represents opening timing of the intake valve 12, IVC represents closing timing of the intake valve 12, EVO represents opening timing of the exhaust valve 14, and EVC represents closing timing of the exhaust valve 14, respectively. Further, each of the ranges of the crank angles shown by the black circular arcs in the drawing shows the fuel injection time period by intake-asynchronous injection.

In the next step S106, ignition is performed in the ignition sequence from the first explosion stroke cylinder, that is, in the sequence of the first cylinder, the third cylinder, the fourth cylinder and the second cylinder. The ignition time is in proximity to a compression top dead center.

In step S108, after implementation of ignition, the exhaust valve stop control is removed in the sequence of the first cylinder, the third cylinder, the fourth cylinder and the second cylinder. When the exhaust valve stop control is removed, ordinary exhaust valve control is automatically performed. In the ordinary exhaust valve control, the first rocker arm 341 and the second rocker arms 342 and 343 are switched to the connected state (state shown in FIG. 5) by operation of the actuator 359 by the ECU 50. The operation is performed before the target cylinder enters an exhaust stroke, that is, while the target cylinder is in an explosion stroke, after ignition.

Figure 8:
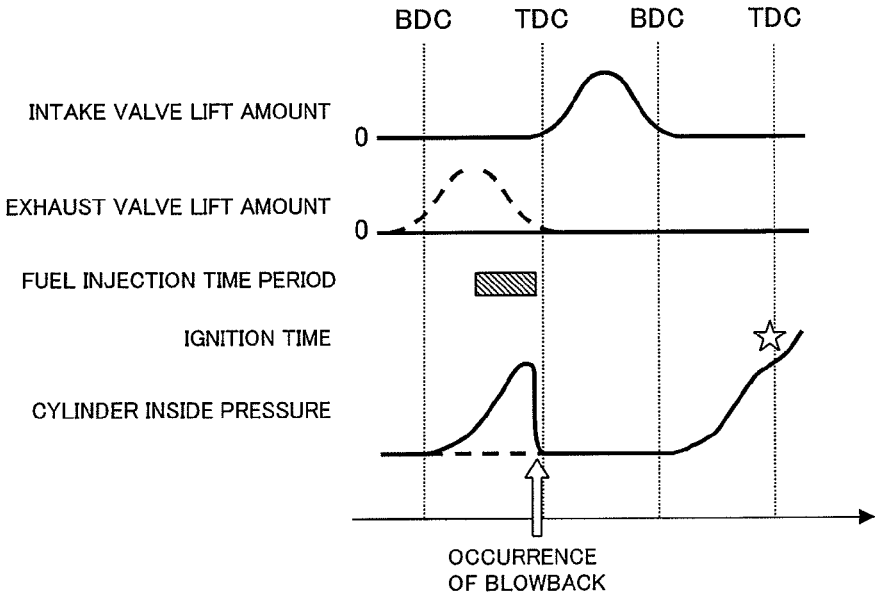
FIG. 8 is a crank angle diagram showing the content of start control which is executed in embodiment 1 of the present invention.

FIG. 8 shows the content of start control according to the present embodiment in the crank angle diagram. In the drawing, each of lift amounts of the intake valve 12 and the exhaust valve 14 and each of changes in the cylinder inside pressure in the first cylinder from the time point of start of cranking, and the injection time period of the fuel for initial explosion and the ignition time are shown with a common axis of abscissa. Further, in regard with the lift amount of the exhaust valve 14 and the cylinder inside pressure, the case in which the exhaust valve stop control is not carried out, that is, the case in which the ordinary exhaust valve control is carried out from the beginning is shown by the broken line as a comparative example.

As is also known from FIG. 8, according to the start control according to the present embodiment, the exhaust valve 14 is stopped in the closed state in the exhaust stroke, whereby the gas in the combustion chamber 10 is compressed by the piston 8, and when the pressure (cylinder inside pressure) in the combustion chamber 10 becomes high, the intake valve 12 is opened. Accordingly, when the intake valve 12 is opened, blowback of the gas to the intake port 36 from the combustion chamber 10 occurs by the pressure difference between the intake port 36 and the combustion chamber 10. The gas which is blown back at this time is at a high speed, and is at a high temperature by polytropic compression in the cylinder at the same time. If the exhaust valve stop control is not implemented, the cylinder inside pressure in the exhaust stroke does not increase as shown by the broken line, and therefore, such blowback cannot be generated.

Further, according to the start control according to the present embodiment, the fuel for initial explosion is injected by intake-asynchronous injection, and therefore, in the timing in which the intake valve 12 is opened, most of the fuel becomes droplets to accumulate in proximity to the intake valve 12 of the intake port 36, and part of the fuel is in a misty state toward the intake valve 12. When the intake valve 12 is opened, blowback of the gas to the intake port 36 occurs from the combustion chamber 10 as described above. By being blown off and stirred by the high-speed and high-temperature gas which is blown back at this time, the fuel for initial explosion in the intake port 36 becomes fuel vapor which is more advanced in vaporization or a misty fuel which is more advanced in atomization.

As described above, according to the control device according to the present embodiment, vaporization or atomization of the fuel for initial explosion can be promoted. Accordingly, at the time of start, discharge of unburned HC at the time of start, especially at the time of cold start can be restrained. Further, in the case of use of heavy gasoline which is difficult to vaporize as a fuel, or in the case of use of alcohol or alcohol blended gasoline, a more remarkable effect can be obtained in the respect of restraint of unburned HC by promotion of vaporization or atomization of a fuel.

Embodiment 2

Next, embodiment 2 of the present invention will be described with reference to FIGS. 9 and 10.

A control device as embodiment 2 of the present invention is applied to the engine with the configuration shown in FIG. 1 as in embodiment 1. Accordingly, in the following description, the description is made on the precondition of the engine shown in FIG. 1 as in embodiment 1.

The present embodiment has the feature in start control of the engine which is executed by the ECU 50. The feature of the start control according to the present embodiment is in implementing the aforementioned exhaust valve stop control only when a certain condition is satisfied, and implementing ordinary exhaust valve control from the beginning when the condition is not satisfied. The condition is the condition relating to the concentration of alcohol (ethanol in this case) contained in the fuel and the engine water temperature at the time of start. More specifically, implementation/prohibition of exhaust valve stop control is determined in accordance with a determination diagram shown in FIG. 9. If the relationship of the ethanol concentration and the start time water temperature is in an implementation region of the exhaust valve stop control in FIG. 9, the exhaust valve stop control is implemented as in embodiment 1. If the relationship of the ethanol concentration and the start time water temperature is in the prohibition region of the exhaust valve stop control, ordinary exhaust valve control is implemented.

Figure 9:
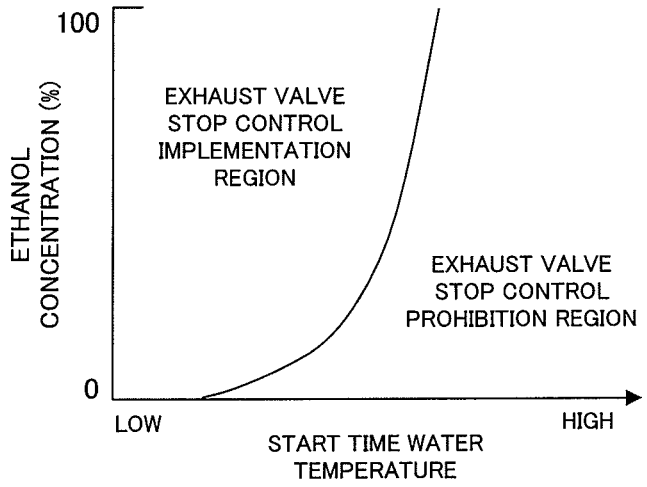
FIG. 9 is an illustration explaining the method to determine implementation/prohibition of exhaust valve stop control in accordance with the ethanol concentration and the start time water temperature.

As shown in FIG. 9, in the present embodiment, when the start time water temperature is set as constant, if the ethanol concentration is a reference concentration determined from the water temperature at this time or more, exhaust valve stop control is implemented. This is because as the ethanol concentration is higher, the fuel is more difficult to vaporize. Further, when the ethanol concentration is set as constant, if the start time water temperature is a reference temperature determined from the ethanol concentration at this time or lower, the exhaust valve stop control is implemented. This is because as the water temperature is lower, the temperature of the wall surface of the intake port 36 is lower, and the fuel is difficult to vaporize. In the present embodiment, the exhaust valve stop control for promoting vaporization or atomization of the fuel is implemented only under the environment where the fuel is difficult to vaporize, whereas under the environment where the fuel is relatively easily vaporized, a high priority is given to the starting performance, and ordinary exhaust valve control is selected.

Start control according to the present embodiment is on the basis of the start control according to embodiment 1. FIG. 10 shows the content of the start control which is executed by the ECU 50 in the present embodiment in a flowchart. The processing common to embodiment 1 of each processing shown in the flowchart of FIG. 10 is assigned with the same step number as that in embodiment 1. Hereinafter, the description of the processing common to that of embodiment 1 will be omitted or simplified, and the processing differing from that of embodiment 1 will be predominantly described.

According to the flowchart of FIG. 10, in the initial step S200, the ethanol concentration of the fuel is acquired by the alcohol concentration sensor 56. Further, the engine water temperature at the time of start is acquired by the water temperature sensor 54. The processing of step S200 is implemented at only the initial time, and is skipped at the next time and thereafter.

In the next step S202, implementation/prohibition of the exhaust valve stop control is determined by referring to the determination chart shown in FIG. 10 for the ethanol concentration and the start time water temperature which are acquired in step S200. If the exhaust valve stop control is implemented as a result of determination, the flow directly proceeds to step S206. Meanwhile, if the exhaust valve stop control is prohibited, the flow proceeds to step S206 after going through processing of step S204. In step S204, an exhaust valve operation flag indicating the prohibition of the exhaust valve stop control is set at 1. If the initial value of the exhaust valve operation is 0, and the flow directly proceeds to step S206, the exhaust valve operation flag is set at 0.

In the next step S206, it is determined whether the exhaust valve operation flag is at 0. The determination is performed for each cylinder. If the exhaust valve operation flag in a certain cylinder is at 0, the processing of steps S100 to S108 is performed as in embodiment 1 in regard with the cylinder. By series of processing, vaporization or atomization of the fuel for initial explosion is promoted, and discharge of unburned HC in the situation in which the ethanol concentration is high or the start time water temperature is low is restrained. Subsequently, in the sequence of the cylinder in which the processing of steps S100 to S108 is completed, the exhaust valve operation flag is set at 1 in the final step S210.

Meanwhile, when the exhaust valve operation flag in a certain cylinder is at 1, the processing of step S208 is performed in regard with the cylinder. In step S208, ordinary exhaust valve control is performed, and ordinary fuel injection time control and ignition control are performed. More specifically, when the ethanol concentration is relatively low, and when the start time water temperature is relatively high, the ordinary engine control is performed from the stage of the initial explosion.

Embodiment 3

Next, embodiment 3 of the present invention will be described with reference to each of FIGS. 11 to 13.

A control device as embodiment 3 of the present invention is applied to an engine with the configuration shown in FIG. 1 as in embodiment 1. Accordingly, in the following description, the description will be made with the engine shown in FIG. 1 as a precondition as in embodiment 1.

The present embodiment has a feature in start control of the engine which is executed by the ECU 50. The feature of the start control according to the present embodiment is in implementing ignition after performing cranking for one or a plurality of cycles with the exhaust valve 14 kept stopped, after injection of a fuel for initial explosion, instead of implementing ignition in the cycle. Shift to the ordinary exhaust valve control from the exhaust valve stop control is performed in the sequence of the cylinder where ignition is finished after implementation of ignition.

Figure 11:
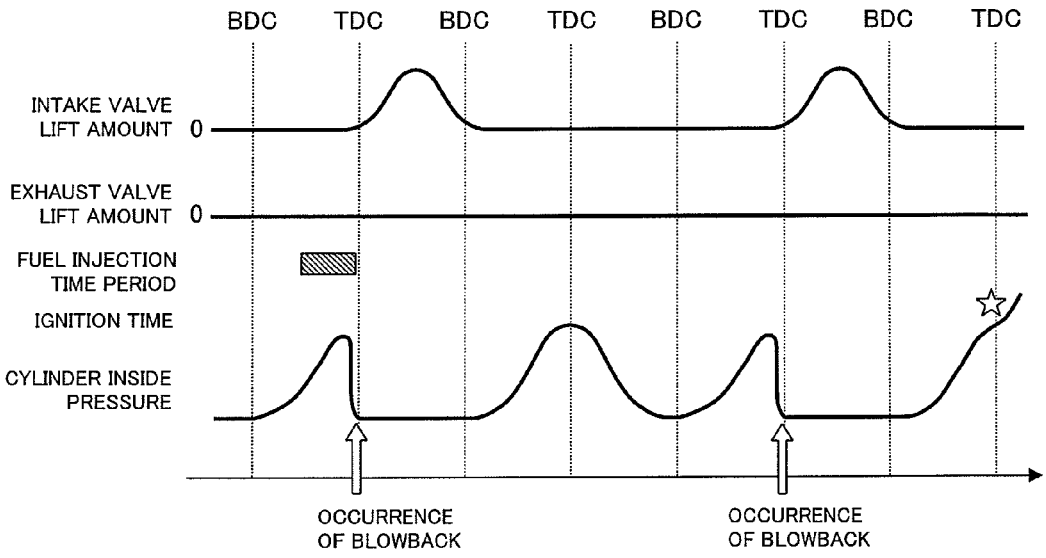
FIG. 11 is a crank angle diagram showing the content of start control which is executed in embodiment 3 of the present invention.

FIG. 11 shows the content of the start control according to the present embodiment in a crank angle diagram. In the drawing, ignition is implemented after cranking is performed for two cycles with the exhaust valve 14 kept closed. Such an operation is performed by the engine, and thereby, blowback of the gas compressed in the cylinder to the intake port 36 is repeated, and vaporization or atomization of the fuel for first explosion is further promoted. More specifically, the fuel injected to the intake port 36 is blown off and stirred by the initial blowback from the combustion chamber 10. The fuel which is promoted in vaporization and atomization by stirring is taken into the combustion chamber 10 with the gas in the intake port 36 in an intake stroke, and when the intake valve 12 is opened next, the fuel is blown back to the intake port 36 from the combustion chamber 10 with the cylinder inside gas at a high temperature and high pressure. As a result, further vaporization or atomization of the fuel in the cylinder inside gas is promoted, and vaporization or atomization of the fuel remaining in the intake port 36 is promoted at the same time.

The number of cycles (hereinafter, called the number of stop cycles) in which cranking is performed with the exhaust valve 14 stopped may be fixed to a constant number of cycles. However, in the start control according to the present embodiment, the number of stop cycles is changed in accordance with the concentration of alcohol (ethanol in this case) contained in the fuel and the engine water temperature at the time of start. More specifically, the number of stop cycles is determined in accordance with the determination diagram shown in FIG. 12. If the relationship between the ethanol concentration and the start time water temperature is in an N cycle implementation region in FIG. 12, the number of stop cycles is N. In this case, cranking with the exhaust valve 14 stopped is performed for N cycles, and blowback from the combustion chamber 10 to the intake port 36 occurs N times. If the relationship between the ethanol concentration and the start time water temperature is in the prohibition region of the exhaust valve stop control, cranking with the exhaust valve 14 stopped is not performed, and ordinary exhaust valve control is implemented.

Figure 12:
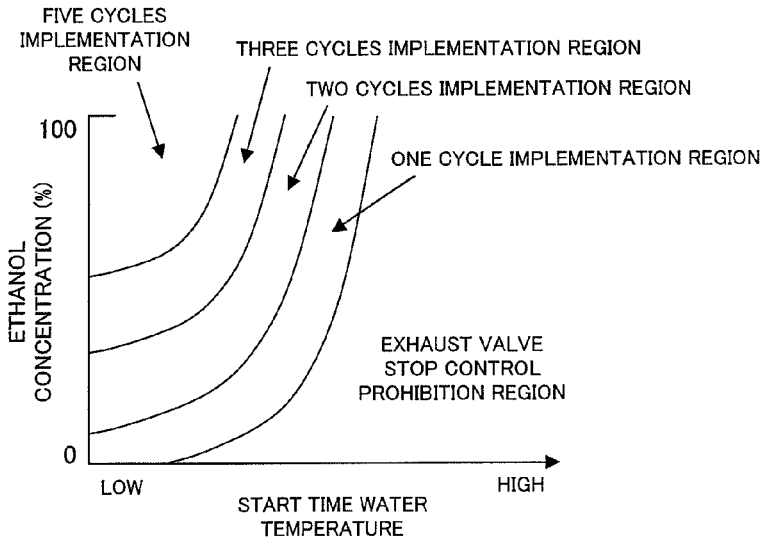
FIG. 12 is an illustration explaining the setting of the number of exhaust valve stop cycles in accordance with the ethanol concentration and the start time water temperature.

As shown in FIG. 12, in the present embodiment, when the start time water temperature is set as constant, the number of stop cycles is increased as the ethanol concentration becomes higher. Further, when the ethanol concentration is set as constant, the number of stop cycles is increased as the start time water temperature becomes lower. The reason why the number of stop cycles is changed in accordance with the ethanol concentration and the start time water temperature is that simply increasing the number of stop cycles is advantageous with regard to promotion of vaporization or atomization of the fuel, but is disadvantageous in the respect of quick start of the engine. By determining the number of stop cycles in accordance with the determination diagram shown in FIG. 12, restraint of discharge of HC by promotion of vaporization or atomization of the fuel and starting performance of the engine during cold start can be favorably made compatible.

The start control according to the present embodiment is based on the start control according to embodiment 2. FIG. 13 shows the content of the start control executed by the ECU 50 in the present embodiment in the flowchart. Of each processing shown in the flowchart of FIG. 13, the processing common to embodiment 2 is assigned with the same step number as that of embodiment 2. Hereinafter, the description of the processing common to embodiment 2 will be omitted or simplified, and the processing differing from that of embodiment 2 will be predominantly described.

According to the flowchart of FIG. 13, if the exhaust valve stop control is implemented as a result of the determination of step S202, the flow goes through the processing of step S300 and proceeds to step S206. In step S300, the number of stop cycles is determined by referring to the determination diagram shown in FIG. 12 for the ethanol concentration and the start time water temperature which are acquired in step S200. The processing of step S300 is implemented only at the initial time, and is skipped at the next time and thereafter.

As a result of the determination of step S206, if the exhaust valve operation flag is at 0, the flow proceeds to step S100, and the processing of steps S100 to S104 is performed. In the present embodiment, after intake-asynchronous injection is implemented in step S104, and the flow goes through the processing of steps S302 and S304, and thereafter, proceeds to step S106. In step S302, it is determined whether the number of stop cycles determined in step S300 has elapsed. If the determined number of stop cycles has not elapsed yet, the flow goes through step S304, and thereafter, returns to step S300 again, where the determination is performed. In step S304, cranking is continued while ignition is being stopped.

The processing of step S302 and step S304 is repeatedly performed until the number of stop cycles elapses. During that while, blowback of the gas compressed in the cylinder to the intake port 36 is repeated, and vaporization or atomization of the fuel injected in step S104 is promoted. After the number of stop cycles elapses, the flow proceeds to step S106, and ignition is performed. Immediately thereafter, the exhaust valve stop control is removed in step S108.

Embodiment 4

Next, embodiment 4 of the present invention will be described with reference to FIGS. 14 and 15.

A control device as embodiment 4 of the present invention is applied to the engine of the configuration shown in FIG. 1 as in embodiment 1. Accordingly, in the following description, the description will be made with the engine shown in FIG. 1 as a precondition as in embodiment 1.

The present embodiment has a feature in start control of the engine which is executed by the ECU 50. The feature of the start control according to the present embodiment is in implementing ignition after performing cranking with the exhaust valve 14 stopped for one or a plurality of cycles, and injecting the fuel for initial explosion by dividing the fuel in accordance with the number of cycles for stopping the exhaust valve 14. The fuel injection timing in each divided injection is such that the end time of the fuel injection time period coincides with the opening timing of the intake valve 12. More specifically, in accordance with repetition of blowout of the gas compressed in the cylinder to the intake port 36, fuel injection is implemented so that the gas which is blown back and the injected fuel collide with each other. Shift to ordinary exhaust valve control from the exhaust valve stop control is performed in the sequence from the cylinder where ignition is finished after implementation of the ignition.

Figure 14:
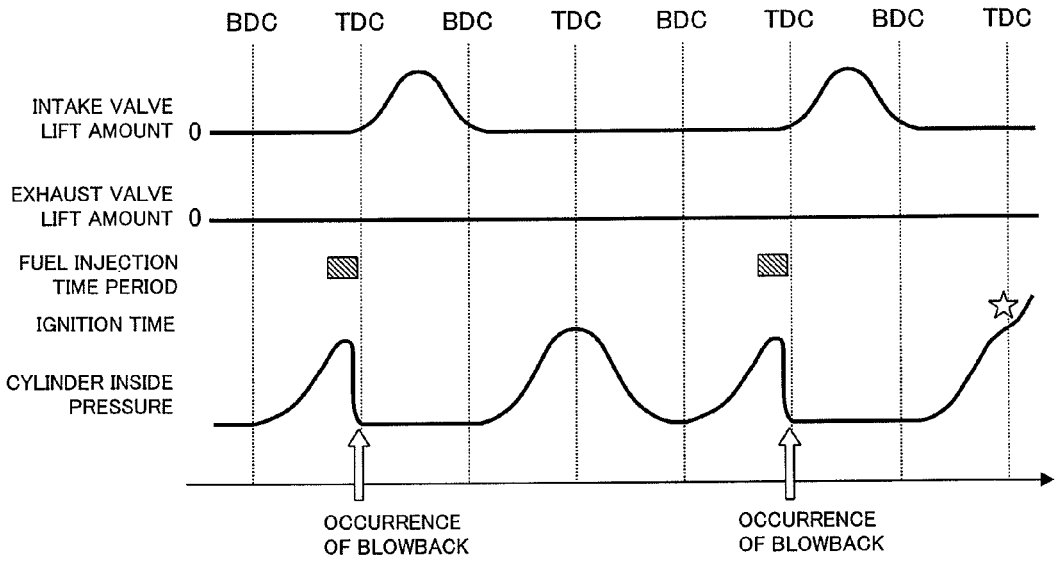
FIG. 14 is a crank angle diagram showing the content of start control which is executed in embodiment 4 of the present invention.

FIG. 14 shows the content of the start control according to the present embodiment in a crank angle diagram. In the drawing, ignition is implemented after cranking is performed for two cycles with the exhaust valve 14 kept closed. Further, the fuel is divisively injected in accordance with the opening timing of the intake valve 12 in each cycle so that the blowback of the gas in the cylinder which occurs in each cycle and the fuel injected from the fuel injection valve 34 collide with each other. Such an operation is performed by the engine, whereby the energy which is given to the fuel from the high-pressure gas which is blown back can be made large, and vaporization or atomization of the fuel for initial explosion can be further promoted as compared with the case of injecting the whole fuel in the first cycle.

The number of stop cycles in which cranking is performed while the exhaust valve 14 is kept stopped may be fixed to a fixed number of cycles. However, in the start control according to the present embodiment, the number of stop cycles is determined in accordance with the determination diagram shown in FIG. 12 which is shown above as in embodiment 2. The fuel for initial explosion is divided in accordance with the number of stop cycles which is determined. For example, if the number of the stop cycles is N, the fuel is also divided into N to be injected.

The fuel injection ratio of each injection to the total fuel injection amount can be made uniform among injections. In the example shown in FIG. 14, the fuel injection ratio of the first cycle and the fuel injection ratio of the second cycle are made equal. However, a difference can be given to the fuel injection ratio at each injection in accordance with the sequence of injection. For example, the fuel injection ratio of the first cycle may be set to be high, and the fuel injection ratios of the later cycles may be set to be lower. In doing so, the promotion effect of vaporization which can be obtained by directly throwing the fuel at blowback, and the promotion effect of vaporization which is obtained by repeatedly involving the fuel in blowback can be made compatible.

The start control according to the present embodiment is based on the start control according to embodiment 3. FIG. 15 shows the content of start control executed by the ECU 50 in the present embodiment in the flowchart. Of each processing shown in the flowchart of FIG. 15, the processing common to embodiment 3 is assigned with the same step number as that of embodiment 3. Hereinafter, the description of the processing common to embodiment 3 will be omitted or simplified, and the processing differing from that of embodiment 3 will be predominantly described.

According to the flowchart of FIG. 15, the exhaust valve stop control is implemented in step S102, and thereafter, processing of step S400 is performed first. In step S400, the fuel injection amount for each cycle is calculated in accordance with the number of stop cycles determined in step S300. The processing of step S400 is implemented only at the initial time, and is skipped at the next time and thereafter.

In the next step S402, fuel injection is performed in accordance with the fuel injection amount calculated in step S400 in the sequence of ignition from the first explosion stroke cylinder. The fuel injection timing in each of the cylinders is set so that the end time of the fuel injection time period coincides with the opening timing of the intake valve 12 of the cylinder.

Subsequently, the flow goes through the processing of steps S302 and S304, and thereafter, the processing of step S402 is performed again. The series of processing is repeatedly performed until the number of stopping cycles elapses. During that while, the fuel is injected toward blowback of the cylinder inside gas which occurs each time the intake valve 12 is opened, and vaporization or atomization of the fuel is promoted. Subsequently, when the number of stop cycles elapses, the flow proceeds to step S106, and ignition is performed. Immediately thereafter, the exhaust valve stop control is removed in step S108.

Embodiment 5

Next, embodiment 5 of the present invention will be described with reference to FIGS. 16 and 17.

A control device as embodiment 5 of the present invention is applied to the engine with the configuration shown in FIG. 1 as in embodiment 1. Accordingly, in the following description, the description will be made with the engine shown in FIG. 1 as a precondition similarly to embodiment 1.

In embodiment 3, the exhaust valve control and the ignition control are made to cooperate with each other by the ECU 50, whereby cranking with the exhaust valve 14 stopped is performed for one or a plurality of cycles, and thereafter, ignition is implemented. However, unless there is no linkage between the exhaust valve control and the ignition control, if an abnormality occurs in one control, a trouble is likely to occur to the control of the entire engine. For example, if the exhaust valve 14 is opened without being stopped due to an abnormality of the exhaust valve control, unburned gas is discharged from the combustion chamber 10 to the exhaust port 40 in the next exhaust stroke, since ignition is stopped.

The present embodiment has a feature in start control of the engine which is executed by the ECU 50. The feature of the start control according to the present embodiment is fail safe in the case of implementing ignition after performing cranking with the exhaust valve 14 kept stopped, for one or a plurality of cycles. When the exhaust valve 14 is opened in a certain cylinder, even though the number of cycles in which ignition is stopped has not elapsed, ignition of the corresponding cylinder is executed in the ignition timing immediately thereafter. Further, the exhaust valve stop control is immediately stopped, and the control is shifted to ordinary exhaust valve control from the exhaust valve stop control. Such a fail safe function is incorporated in the start control, and thereby unburned gas is prevented from being discharged by error control of the exhaust valve 14.

Figure 16:
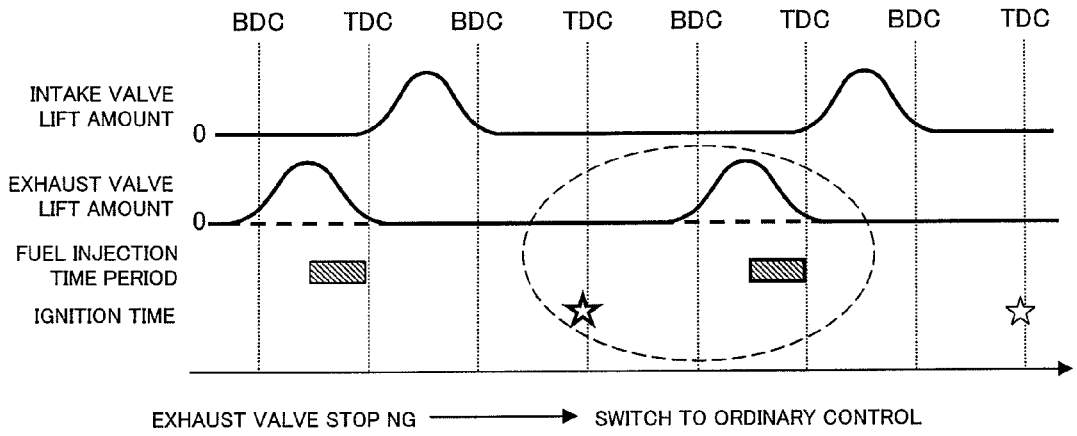
FIG. 16 is a crank angle diagram showing the content of start control which is executed in embodiment 5 of the present invention.

FIG. 16 shows the content of the start control according to the present embodiment in a crank angle diagram. The drawing shows the case in which the exhaust valve 14 is opened from the first cycle though it is planned to perform cranking with the exhaust valve 14 kept closed for two cycles and implement ignition as shown by the broken lines. In this case, the control is immediately switched to the ordinary control and ignition is executed in the ignition timing of the first cycle. Switch to the ordinary control described here includes switch to the ordinary exhaust valve control from the exhaust valve stop control. When the exhaust valve stop control itself is effective, the exhaust valve 14 is likely to be closed in the second cycle though the exhaust valve 14 is opened in the first cycle. When the exhaust valve 14 is not opened through ignition is executed, increase in the internal EGR is caused, and the adverse effect is exerted on the next combustion. By switching the control to the ordinary control including the exhaust valve control, the abnormality of the exhaust valve control can be prevented from extending to a trouble as the entire engine.

Whether the exhaust valve 14 stops can be determined from the operation state of an actuator 359. The timing for the determination can be before the timing which is in time for execution of ignition. When ignition is implemented after cranking with the exhaust valve 14 kept closed is performed for N cycles, at each of the first cycle to $(N-1)^{th}$ cycle, whether the exhaust valve 14 is stopping is determined prior to ignition timing.

The start control according to the present embodiment is on the basis of the start control according to embodiment 3. FIG. 17 shows the content of the start control executed by the ECU 50 in the present embodiment in the flowchart. Of each processing shown in the flowchart of FIG. 7, the process common to embodiment 3 is assigned with the same step number as that of embodiment 3. Further, the processing before step S104 and the processing after step S106 are common to embodiment 3, and therefore, illustration in the flowchart is omitted in regard with them. Hereinafter, the description of the processing common to embodiment 3 will be omitted or simplified, and the processing differing from that of embodiment 3 will be predominantly described.

According to the flowchart of FIG. 17, the intake-asynchronous injection is implemented in step S104, and thereafter, the flow goes through processing of step S500 to proceed to step S302. In step S500, it is determined for each cylinder whether the exhaust valve 14 is actually stopped in the exhaust stroke. If the exhaust valve 14 is stopped without fail, the flow proceeds to step S302, and cranking is continued with ignition stopped until the number of stop cycles elapses.

If the exhaust valve 14 is not stopped as a result of the determination of step S500, processing of step S502 and processing of step S504 are implemented. In step S502, the exhaust valve stop control is suspended, and the exhaust valve operation flag is set at 1. The exhaust valve stop control may be stopped in only the cylinder in which the exhaust valve 14 is not stopped, or may be stopped uniformly for all the cylinders. According to the former, in the other cylinders where the exhaust valves 14 are stopped, vaporization or atomization of the fuel can be promoted by continuation of cranking According to the latter, a variation in the combustion start timing among the cylinders is prevented, and favorable starting performance can be ensured.

In the next step S504, the ordinary exhaust valve control is performed in the cylinder where the exhaust valve stop control is stopped, and the ordinary fuel injection time control and ignition control are performed.

Embodiment 6

Figure 18:
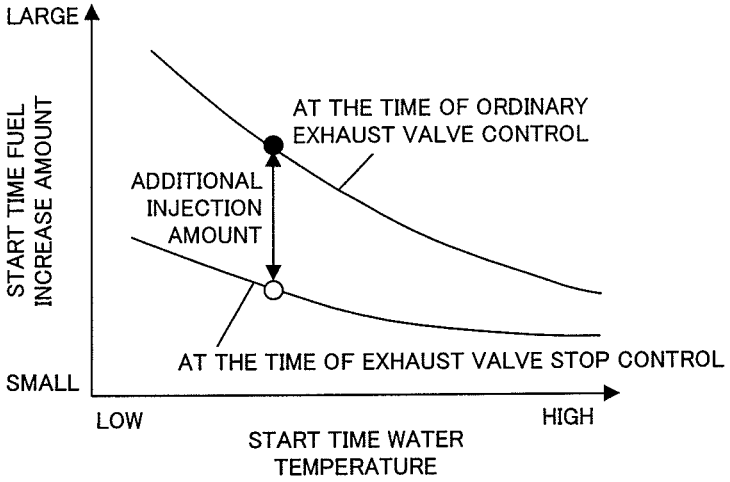
FIG. 18 is an illustration explaining the setting of the start time fuel increase amount in accordance with the start time water temperature.

Next, embodiment 6 of the present invention will be described with reference to FIGS. 18 and 19.

A control device as embodiment 6 of the present invention is applied to the engine of the configuration shown in FIG. 1 as in embodiment 1. Accordingly, in the following description, the description is performed with the engine shown in FIG. 1 as a precondition similarly to embodiment 1.

The present embodiment has a feature in start control of the engine which is executed by the ECU 50. FIG. 18 is a graph showing relationship between a water temperature at a time of start and a required fuel increase amount. At the time of start of the engine, vaporization of the fuel is insufficient, and therefore, supply of more fuel than the fuel amount fixed from a target air-fuel ratio is required. The required fuel increase amount becomes larger as the water temperature is lower. However, there is a difference between the case of performing ordinary exhaust valve control and the case of performing the exhaust valve stop control, and in the case of the latter capable of promoting vaporization or atomization of the fuel, the fuel increase amount can be made small. Therefore, on the precondition that the exhaust valve stop control is implemented, the injection amount of the fuel for initial explosion is restrained to be smaller than usual.

According to embodiment 5, if the exhaust valve 14 is not stopped due to erroneous control, the flow immediately shifts to the ordinary control and ignition is executed. In this case, discharge of unburned gas is prevented, but vaporization or atomization of the fuel is insufficient, and therefore, the fuel which contributes to combustion becomes insufficient. More specifically, if the exhaust valve stop control is implemented, the fuel increase amount shown by the white circle in FIG. 18 should be sufficient, but since the control is changed to the ordinary control, the fuel increase amount shown by the black circle is required, and the fuel supply amount becomes insufficient by the difference between them.

The start control according to the present embodiment is further improvement of the start control according to embodiment 5. In the present embodiment, when the exhaust valve 14 opens in a certain cylinder even though the number of cycles in which the ignition is stopped has not elapsed, additional fuel injection is executed during the intake stroke immediately thereafter, and thereafter, ignition of the cylinder is executed. The amount of the fuel additionally injected is the difference (shown by the arrow in FIG. 18) between the fuel increase amount at the time of start at the time of ordinary exhaust valve control and the fuel increase amount at the time of start at the time of exhaust valve stop control, and is calculated from the water temperature at the time of start. Such a function is incorporated into the start control in combination with the fail safe function, whereby worsening of the starting performance due to supply shortage of the fuel can be prevented.

The start control according to the present embodiment is on the basis of the start control according to embodiment 5. FIG. 19 shows the content of the start control executed by the ECU 50 in the present embodiment in the flowchart. Of each processing shown in the flowchart of FIG. 19, the processing common to embodiment 5 is assigned with the same step number as that of embodiment 5. Hereinafter, the description of the processing common to embodiment 5 will be omitted or simplified, and the processing differing from embodiment 3 will be predominantly described.

According to the flowchart of FIG. 19, if the exhaust valve 14 is not stopped in a certain cylinder as a result of the determination of step S500, processing of step S600 is implemented subsequently from the processing of step S502. However, the present embodiment has starting performance as an object, and therefore, even if the exhaust valves 14 are not stopped in some of the cylinders, exhaust valve stop control is suspended uniformly for all the cylinders.

In step S600, additional fuel injection is implemented in the cylinder where the exhaust valve 14 is not stopped. This does not apply to the cylinder where the exhaust valve stop control is correctly implemented. The timing of the additional fuel injection is the time until the intake valve 12 of the cylinder is closed. More specifically, the additional fuel injection can be intake-asynchronous injection. If the implementation timing of the processing of step S600 is in time for the time of end of the intake-asynchronous injection which is implemented in step S104, the injection time period of the intake-asynchronous injection is extended correspondingly to the additional fuel amount to cope with the situation. After the processing of step S600, the processing of step S504 is subsequently implemented.

Embodiment 7

Figure 20:
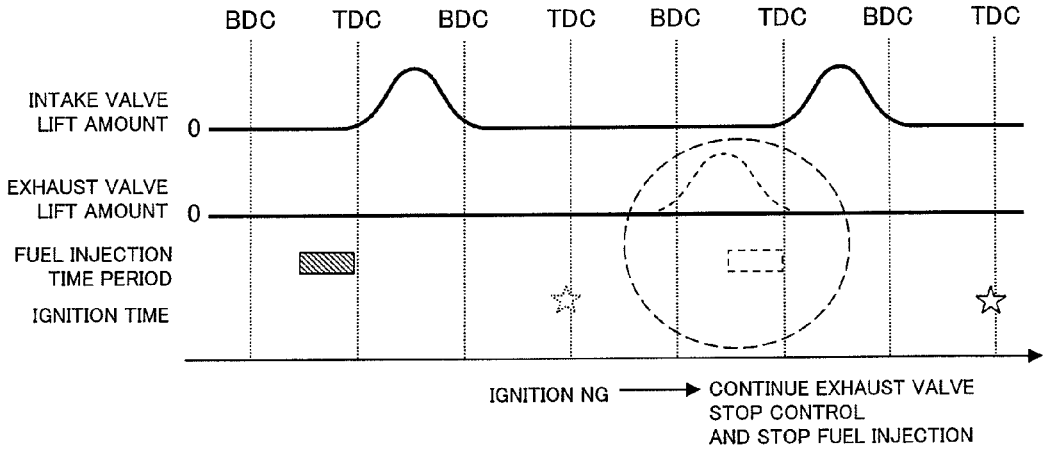
FIG. 20 is a crank angle diagram showing the content of start control which is executed in embodiment 7 of the present invention.

Next, embodiment 7 of the present invention will be described with reference to FIGS. 20 and 21.

A control device as embodiment 7 of the present invention is applied to the engine having the configuration shown in FIG. 1 as in embodiment 1. Accordingly, in the following description, the description will be made with the engine shown in FIG. 1 as a precondition as in embodiment 1.

As described above, if there is no linkage between the exhaust valve control and the ignition control, a trouble is likely to occur in the control of the entire engine if an abnormality occurs in one of the controls. The abnormality of the exhaust valve control is described in embodiment 5, but an abnormality is likely to occur in ignition control. For example, when ignition is carried out after cranking with the exhaust valve 14 kept stopped is performed for one or a plurality of cycles, the case is conceivable, in which ignition is not executed due to an abnormality in ignition control though the final cranking is completed. In this case, the exhaust valve 14 is opened in the next exhaust stroke, and therefore, unburned gas is directly discharged from the engine.

The present embodiment has the feature in start control of the engine which is executed by the ECU 50. The feature of the start control according to the present embodiment is fail safe in the case of implementing exhaust valve stop control, in more detail, fail safe against an abnormality in ignition control. When ignition is not executed in a certain cylinder though the final cycle in which ignition is stopped is completed, exhaust valve stop control is continued in regard with the cylinder. It is until ignition is executed that the exhaust valve stop control is continued, and fuel injection is stopped during this while Such a fail safe function is incorporated in the start control, whereby discharge of unburned gas by an abnormality in ignition control can be prevented.

Figure 21:
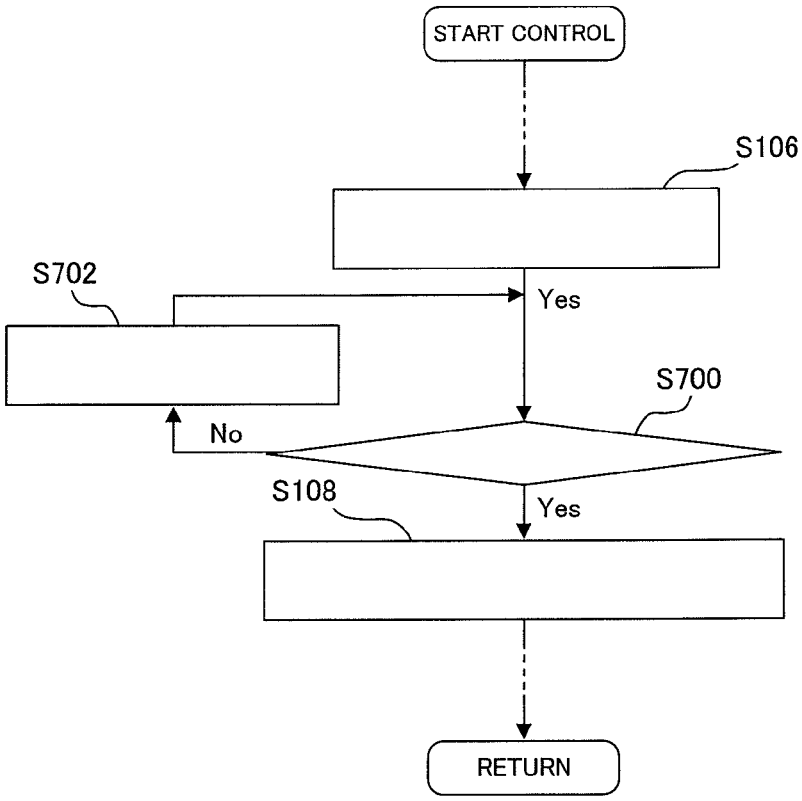
FIG. 21 shows the start control which is executed in embodiment 7 of the present invention in a flowchart.

FIG. 21 shows the content of the start control according to the present embodiment in the crank angle diagram. The drawing shows the case in which ignition is not executed in the ignition timing of the first cycle, while it is planned to implement the exhaust valve stop control for one cycle as shown by the broken line and open the exhaust valve 14 in the second cycle. In this case, the exhaust valve stop control is extended as shown by the solid line, and the fuel injection of the next cycle is suspended. Switch to ordinary exhaust valve control from the exhaust valve stop control is performed after ignition is executed without fail. Further, after ignition is executed without fail, fuel injection is started. Whether ignition is executed can be determined from the electric current which is supplied to the ignition plug 16. Further, it can be determined from the change in the signal from the crank angle sensor.

The start control according to the present embodiment is on the basis of the start control according to embodiment 1. FIG. 21 shows the content of the start control which is executed by the ECU 50 in the present embodiment, in the flowchart. Of each processing shown in the flowchart of FIG. 21, the processing common to embodiment 1 is assigned with the same step number as that of embodiment 1. Further, the processing before step S106 is common to that of embodiment 1, and therefore, display in the flowchart is omitted in regard with it. Hereinafter, the description of the processing common to embodiment 1 will be omitted or simplified, and the processing differing from that of embodiment 1 will be predominantly described. Though the detailed description is omitted, the feature of the start control according to the present embodiment, that is, fail safe against the abnormality in ignition control can be combined with the start control of any of embodiments 2 to 6.

According to the flowchart of FIG. 21, after ignition is performed in step S106, the flow goes through the processing of step S700, and thereafter, proceeds to step S108. In step S700, it is determined for each cylinder whether ignition is actually executed. If ignition is not actually executed, the flow returns to step S700 again after going through step S702, and determination is performed. In step S702, the exhaust vale 14 is stopped in a closed state, and cranking is continued while fuel injection is suspended.

If ignition is executed without fail as a result of the determination of step S700, the flow proceeds to step S108, and the exhaust valve stop control in the cylinder is removed. Further, suspension of the fuel injection is removed in step S108.

Embodiment 8

Next, embodiment 8 of the present invention will be described with reference to FIGS. 22 and 23.

A control device as embodiment 8 of the present invention is applied to the engine having the configuration shown in FIG. 1 as in embodiment 1. Accordingly, in the following description, the description will be made with the engine shown in FIG. 1 as a precondition as in embodiment 1.

The present embodiment has a feature in abnormality diagnosis of the engine which is executed by the ECU 50. As described above, at a time of start of the engine, some abnormalities may occur to exhaust valve control and ignition control. The start controls according to embodiment 5 and embodiment 7 contain the fail safe functions, and therefore, can cope with the abnormalities with the fail safe functions in the case of temporary abnormalities. However, in the case of a permanent abnormality, some measures which are not temporary need to be taken, such as maintenance of the engine. The abnormality diagnosis according to the present embodiment is implemented to find abnormalities of the exhaust valve control and ignition control early, and to encourage the driver of a vehicle to take suitable measures such as maintenance.

Figure 22:
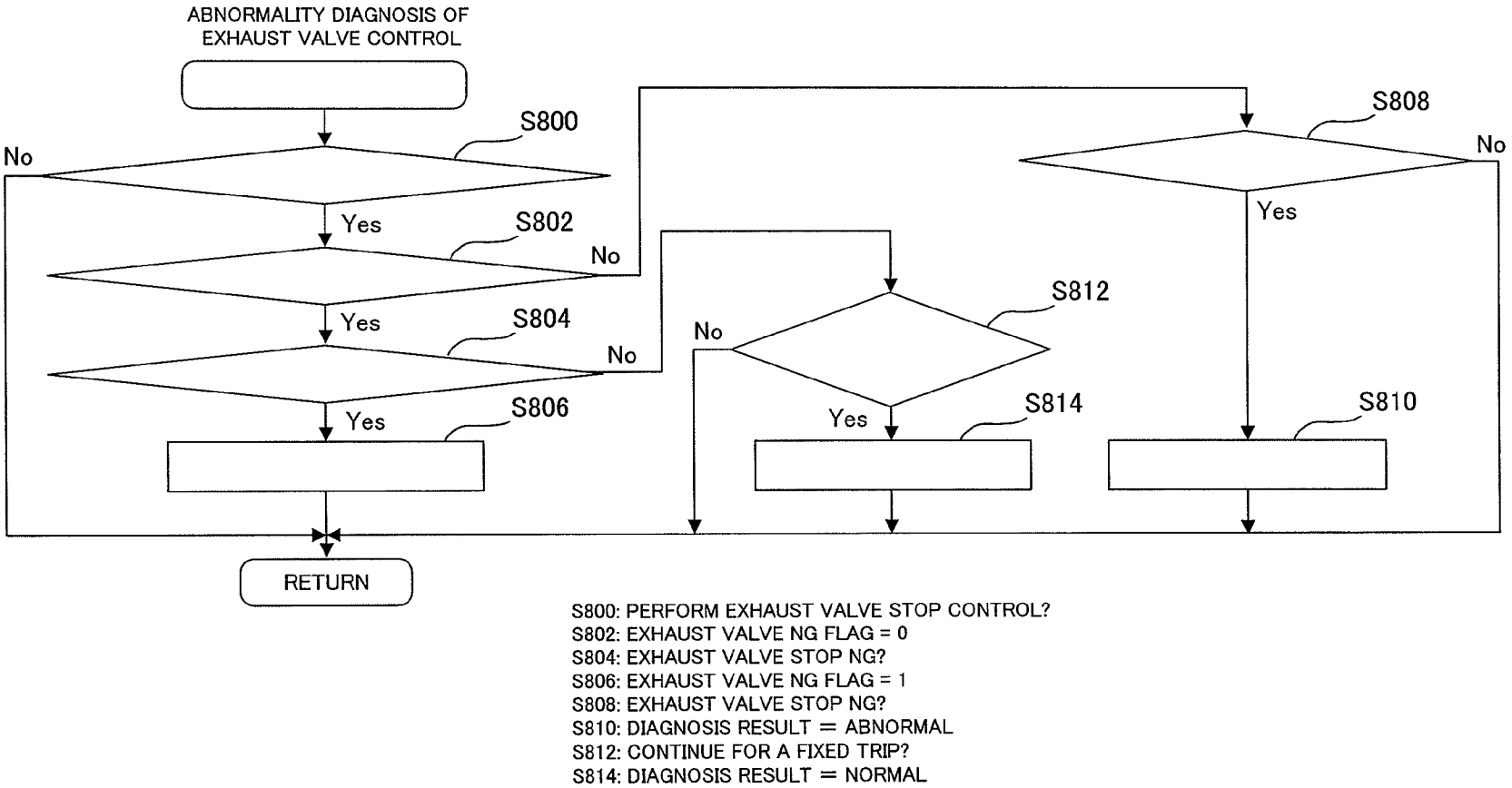
FIG. 22 shows the abnormality diagnosis of exhaust valve control which is executed in embodiment 8 of the present invention in a flowchart.

FIG. 22 shows the content of the abnormality diagnosis of the exhaust valve control which is executed by the ECU 50 in the present embodiment, in the flowchart. The abnormality diagnosis of the exhaust valve control is executed in parallel with the start control of embodiment 5 or embodiment 6 at the time of start of the engine. Further, abnormality diagnosis of the exhaust valve control is performed for each cylinder.

According to the flowchart of FIG. 22, in the first step S800, it is determined whether the exhaust valve stop control is under implementation. If the exhaust valve stop control is not implemented (for example, when the exhaust valve stop control is prohibited because of the start time water temperature and the ethanol concentration), the present routine is ended.

If the exhaust valve stop control is under implementation, the flow proceeds to step S802 and the next determination is performed. In step S802, it is determined whether the exhaust valve NG flag is at 0. The exhaust valve NG flag is the flag which is set at 1 if the exhaust valve 14 is not stopped though the exhaust valve stop control is implemented. The value of the exhaust valve NG flag is also retained after the engine is stopped (after ignition is off), so that at the time of start of the engine, the value retained in the memory is read.

The exhaust valve NG flag being at 0 means that the exhaust valve 14 is normally stopping until at least the previous start. In this case, the flow proceeds to step S804 and the next determination is performed. In step S804, it is determined whether the exhaust valve 14 is not normally stopped in the start of this time.

If the exhaust valve 14 is not normally stopped at this time as a result of the determination of step S804, processing of step S806 is performed. In step S806, the exhaust valve NG flag is set at 1. The value is also retained after the engine is stopped.

If the exhaust valve NG flag is set at 1 in the start of the previous time, the determination result of step S802 of this time is negative determination (No). In this case, the flow proceeds to step S808, and the next determination is performed. In step S808, it is determined whether the exhaust valve 14 is not normally stopped again in the start of this time. More specifically, it is determined whether the situation in which the exhaust valve 14 does not normally stop occurs a plurality of times.

If the exhaust valve 14 is not normally stopped this time as a result of the determination of step S808, the processing of step S810 is performed. In step S810, the diagnosis result that an abnormality occurs to the exhaust valve control is given. The diagnosis result is reflected in the value of the flag for maintenance, and is reported to a driver via means such as an alarm lamp in the instrument panel. If the exhaust valve 14 is normally stopped this time, as a result of the determination of step S808, the diagnosis is postponed to the next time.

Further, if the exhaust valve 14 is not stopped in the past and the exhaust valve 14 is normally stopped this time, that is, if the determination result of step S804 is negative determination, the flow proceeds to step S812 and the next determination is performed. In step S812, it is determined whether the state in which the exhaust valve 14 is normally stopped continues for a fixed trip.

If the exhaust valve 14 is normally stopped continuously for the fixed trip, as a result of the determination of step S812, the processing of step S814 is performed. In step S814, the diagnosis result that the exhaust valve control is normal is given. The diagnosis result is reflected in the value of the flag for maintenance. If the number of trips of the normal stop does not reach the fixed number of trips as a result of the determination of step S812, the diagnosis is postponed to the next time.

Figure 23:
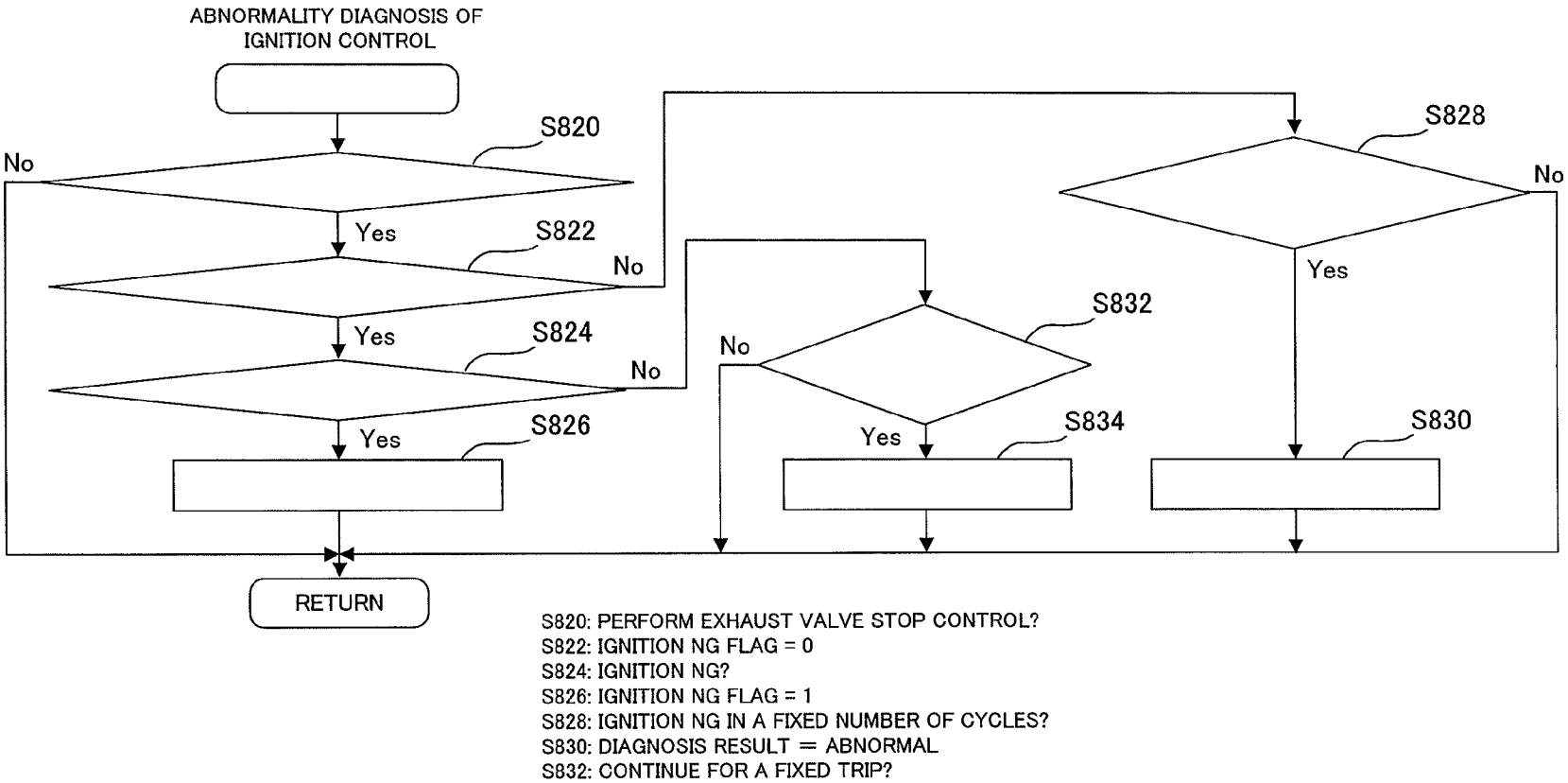
FIG. 23 shows the abnormality diagnosis of ignition control which is executed in embodiment 8 of the present invention in a flowchart.

FIG. 23 shows the content of the abnormality diagnosis of ignition control which is executed by the ECU 50 in the present embodiment, in a flowchart. The abnormality diagnosis of ignition control is executed in parallel with the start control of embodiment 7 at the time of start of the engine. Further, the abnormality diagnosis of ignition control is performed for each cylinder.

According to the flowchart of FIG. 23, in the first step S820, it is determined whether the exhaust valve stop control is under implementation. If the exhaust valve stop control is not implemented (for example, if the exhaust valve stop control is prohibited because of the start time water temperature and ethanol concentration), the present routine is ended.

If the exhaust valve stop control is under implementation, the flow proceeds to step S822 and the next determination is performed. In step S822, it is determined whether the ignition NG flag is at 0. The ignition NG flag is the flag which is set at 1 when the ignition is not executed though the ignition stopping time period ends. The value of the ignition NG flag is also retained even after the engine is stopped, so that the value retained in the memory is read at the time of start of the engine.

The ignition NG flag being at zero means that ignition is normally executed at least until the start of the previous time. In that case, the flow proceeds to step S824, and the next determination is performed. In step S824, it is determined whether the ignition is normally executed in the start of this time.

If the ignition is not normally executed this time, as a result of the determination of step S824, the processing of step S826 is performed. In step S826, the ignition NG flag is set at 1. The value is retained after the engine is stopped.

If the ignition NG flag is set at 1 in the start of the previous time, the determination result of step S822 of this time is negative determination. In that case, the flow proceeds to step S828, and the next determination is performed. In step S828, it is determined whether the situation in which ignition is not normally executed occurs in a fixed number of cycles.

If the number of cycles in which ignition is not normally executed reaches the fixed number of cycles, as a result of the determination of step S828, the processing of step S830 is performed. In step S830, the diagnosis result that an abnormality occurs to the ignition control is given. The diagnosis result is reflected in the value of the flag for maintenance, and the driver is informed of the result via the means such as an alarm lamp in the instrument panel. If the number of cycles does not reache the fixed number of cycles as a result of the determination of step S828, diagnosis is postponed to the next time.

Further, if ignition is not executed in the past, and ignition is also normally executed this time, that is, the determination result of step S824 is negative determination, the flow proceeds to step S832, and the next determination is performed. In step S832, it is determined whether the state in which ignition is normally executed continues for a fixed trip.

If ignition is normally executed continuously for the fixed trip as a result of determination of step S832, the processing of step S834 is performed. In step S834, the diagnosis result that ignition control is normal is given. The diagnosis result is reflected in the value of the flag for maintenance. If the number of trips does not reache the fixed number of trips as the result of the determination of step S832, diagnosis is postponed to the next time.

Embodiment 9

Finally, embodiment 9 of the present invention will be described with reference to FIG. 24.

A control device as embodiment 9 of the present embodiment is applied to the engine having the configuration shown in FIG. 1 as in embodiment 1. Accordingly, in the following description, the description will be made with the engine shown in FIG. 1 as a precondition as in embodiment 1.

The present embodiment has a feature in start control of the engine which is executed by the ECU 50. In embodiments 1 to 7, the exhaust valve 14 is stopped sequentially from the first explosion stroke cylinder, and the following control is implemented with the first explosion stroke cylinder as the reference. However, depending on the response performance of the exhaust valve stop mechanism 24, the exhaust valve 14 cannot be necessarily stopped in the first explosion stroke cylinder. In the start control according to the present embodiment, whether the exhaust valve 14 can be actually stopped is confirmed sequentially from the first explosion stroke cylinder, and the subsequent control is implemented with the cylinder which can stop the exhaust valve 14 first as the reference.

The start control according to the present embodiment is on the basis of the start control according to embodiment 1. FIG. 24 shows the content of the start control which is executed by the ECU 50 in the present embodiment, in the flowchart. Of each processing shown in the flowchart of FIG. 24, the processing common to embodiment 1 is assigned with the same step number as that of embodiment 1. Hereinafter, the description of the processing common to embodiment 1 will be omitted or simplified, and the processing differing from that of embodiment 1 will be predominantly described. Though the detailed description is omitted, the feature of the present embodiment, that is, the start control with the cylinder which can stop the exhaust valve 14 first as the reference can be combined with any of the start controls of embodiments 2 to 7.

Figure 24:
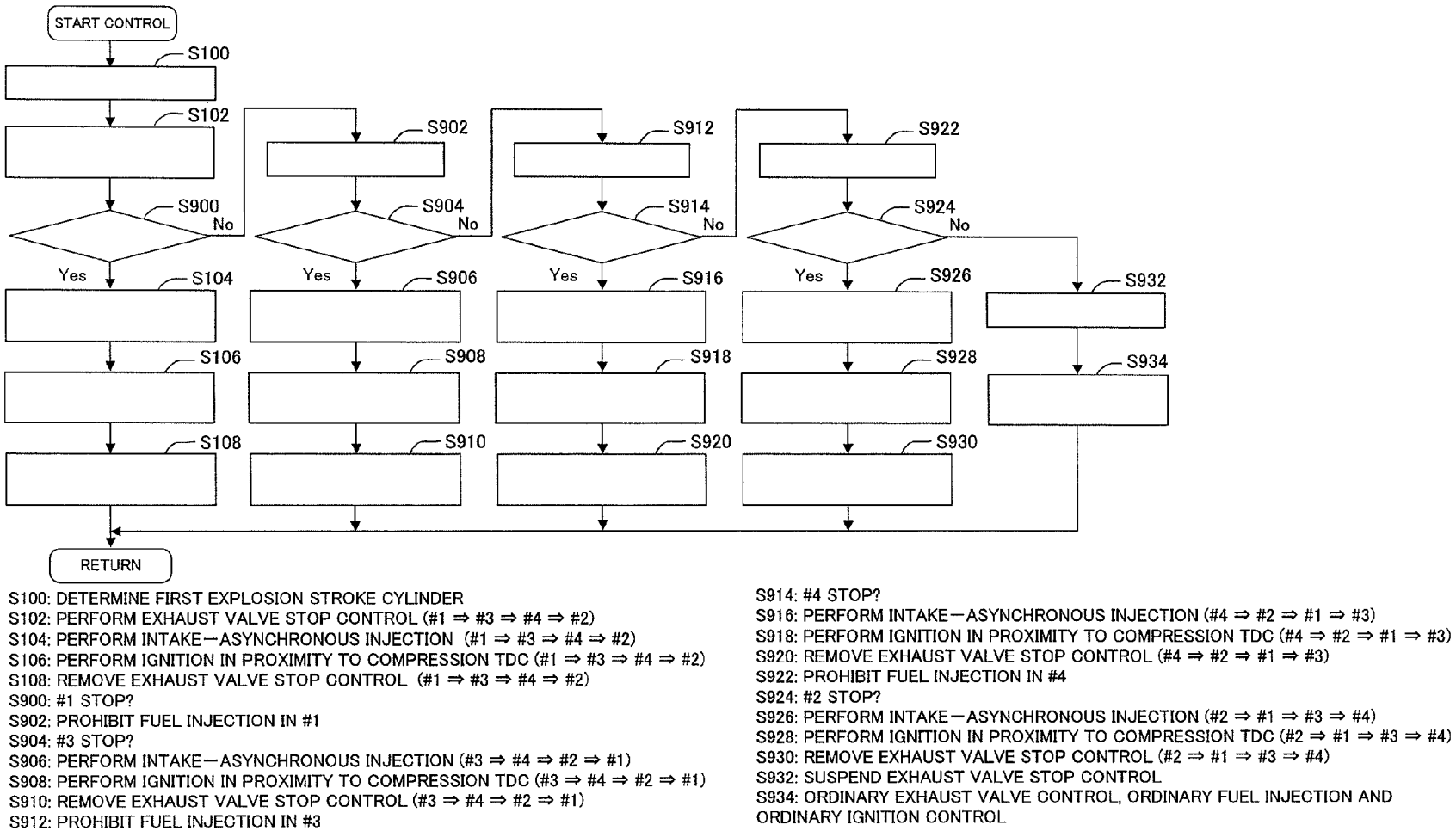
FIG. 24 shows the start control which is executed in embodiment 9 of the present invention in a flowchart.

According to the flowchart of FIG. 24, the exhaust valve stop control is performed in the sequence of ignition from the first explosion stroke cylinder in step S102, and thereafter, determination of step S900 is performed first. In step S900, it is determined whether stop of the exhaust valve 14 of the initial explosion stroke cylinder is in time for the exhaust stroke of the cylinder. In this case, the first explosion stroke cylinder is set as the first cylinder (written as #1 in the flowchart), and ignition is performed in the sequence of the third cylinder (#3), the fourth cylinder (#4) and the second cylinder (#2).

If in the first cylinder, stop of the exhaust valve 14 is in time, the processing of steps S104 to S108 is sequentially performed. More specifically, in step S104, intake-asynchronous injection is sequentially implemented from the first cylinder, ignition in proximity to the compression top dead center is sequentially implemented from the first cylinder in step S106, and removal of the exhaust valve stop control is sequentially implemented from the first cylinder in step S108.

If stop of the exhaust valve 14 of the first cylinder is not in time as a result of the determination of step S900, the processing of step S902 is performed. In step S902, fuel injection in the first cylinder is prohibited. Subsequently, in the next step S904, it is determined whether stop of the exhaust valve 14 of the third cylinder is in time for the exhaust stroke of the cylinder.

If the stop of the exhaust valve 14 is in time in the third cylinder, the processing of steps S906 to S910 is sequentially performed. More specifically, in step S906, intake-asynchronous injection is implemented sequentially from the third cylinder in step S906, ignition in proximity to the compression top dead center is implemented sequentially from the third cylinder in step S908, and removal of the exhaust valve stop control is implemented sequentially from the third cylinder in step S910.

If the stop of the exhaust valve 14 of the third cylinder is not in time as a result of the determination of step S904, the processing of step S912 is performed. In step S912, fuel injection in the third cylinder is prohibited. Subsequently, in the next step S914, it is determined whether stop of the exhaust valve 14 of the fourth cylinder is in time for the exhaust stroke of the cylinder.

If the stop of the exhaust valve 14 is in time in the fourth cylinder, the processing of steps S916 to S920 is sequentially performed. More specifically, in step S916, intake-asynchronous injection is implemented sequentially from the fourth cylinder, ignition in proximity to the compression top dead center is implemented sequentially from the fourth cylinder in step S918, and removal of the exhaust valve stop control is implemented sequentially from the fourth cylinder in step S920.

If the stop of the exhaust valve 14 of the fourth cylinder is not in time, as a result of the determination of step S914, the processing of step S922 is performed. In step S922, fuel injection in the fourth cylinder is prohibited. Subsequently, in the next step S924, it is determined whether stop of the exhaust valve 14 of the second cylinder is in time for the exhaust stroke of the cylinder.

If the stop of the exhaust valve 14 is in time in the second cylinder, the processing of steps S926 to S930 is sequentially performed. More specifically, in step S926, intake-asynchronous injection is implemented sequentially from the second cylinder in step S926, ignition in proximity to the compression top dead center is implemented sequentially from the second cylinder in step S928, and removal of the exhaust valve stop control is implemented sequentially from the second cylinder in step S930.

If the stop of the exhaust valve 14 of the second cylinder is not in time as a result of the determination of step S924, the processing of step S932 and the processing of step S934 are performed. In step S932, the exhaust valve stop control is suspended, and in step S934, ordinary exhaust valve control is performed, while ordinary fuel injection time control and ignition control are performed. More specifically, when stop of the exhaust valve 14 is not in time for the first exhaust stroke in any of the cylinders, the starting performance of the engine is given a priority, and control is switched to ordinary control.

Others

The embodiments of the present invention are described above, but the present invention is not limited to the aforementioned embodiments, and can be implemented by being variously modified in the range without departing from the gist of the present invention. For example, the present invention may be carried out by being modified as follows.

In the aforementioned embodiments, after cranking is started, the exhaust valve 14 is stopped by operating the exhaust valve stop mechanism 24, but the exhaust valve 14 may be stopped before start of cranking More specifically, when the engine is stopped, the exhaust valve 14 may be stopped by operating the exhaust valve stop mechanism 24.

In the aforementioned embodiments, the exhaust valve stop mechanism 24 of the structure shown in FIGS. 2 to 5 is used, but any mechanism that can separate the cam and the exhaust valve 14 can stop the exhaust valve 14 in the closed state. More specifically, the structure of the exhaust valve stop mechanism is not limited to that shown in FIGS. 2 to 5. Further, as the means for stopping the exhaust valve 14 in the closed state, means may be used, which adopts a motor driven type cam, and stops the exhaust valve 14 by stopping the rotation of the cam. Alternatively, means may be used, which adopts an electromagnetically driven type exhaust valve 14, and stops the exhaust valve 14 by operation of the solenoid.

DESCRIPTION OF REFERENCE NUMERALS

10 Combustion chamber
12 Intake valve
14 Exhaust valve
16 Ignition plug
18 Crankshaft
20 Starter
22 Intake valve variable valve timing mechanism
24 Exhaust valve stop mechanism
30 Intake pipe
32 Throttle
34 Fuel injection valve
36 Intake port
40 Exhaust port
50 ECU
52 Crank angle sensor
54 Water temperature sensor
56 Alcohol concentration sensor
59 Start switch

The invention claimed is:

1. A control device for an internal combustion engine having a fuel injection valve which injects a fuel into an intake port, and an exhaust valve which can be stopped in a closed state for each cylinder, comprising:

an exhaust valve control unit which stops the exhaust valve of a cylinder in the closed state when the cylinder before initial explosion is in an exhaust stroke;

a fuel injection valve control unit which causes the fuel injection valve of the cylinder in which the exhaust valve is stopped in the closed state in the exhaust stroke to inject a fuel for initial explosion so that an injection time is before opening timing of an intake valve or coincides with the opening timing; and an ignition control unit which stops ignition of the cylinder until a plurality of cycles elapse after the fuel for initial explosion is injected in each cylinder before initial explosion, wherein the exhaust valve control unit stops the exhaust valve of the cylinder in the closed state until the plurality of cycles in which the ignition is stopped elapse, and the ignition control unit is configured to perform a fail safe function designed to execute ignition of the cylinder at an ignition timing immediately after the exhaust valve of the cylinder opens due to an abnormality of the exhaust valve control unit even though the plurality of cycles in which the ignition is stopped has not elapsed.

* * * * *